US012329349B2

(12) United States Patent
Yang et al.

(10) Patent No.: US 12,329,349 B2
(45) Date of Patent: Jun. 17, 2025

(54) CLEANER

(71) Applicant: LG ELECTRONICS INC., Seoul (KR)

(72) Inventors: In Gyu Yang, Seoul (KR); Jin Hyouk Shin, Seoul (KR); Dae Ho Chang, Seoul (KR); Kyoung Ho Ryou, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 3 days.

(21) Appl. No.: 18/120,793

(22) Filed: Mar. 13, 2023

(65) Prior Publication Data

US 2023/0210329 A1 Jul. 6, 2023

Related U.S. Application Data

(62) Division of application No. 17/018,302, filed on Sep. 11, 2020, now Pat. No. 11,612,289.

(30) Foreign Application Priority Data

Sep. 30, 2019 (KR) ..... 10-2019-0121055

(51) Int. Cl.
*A47L 9/10* (2006.01)
*A47L 9/16* (2006.01)
*A47L 9/32* (2006.01)

(52) U.S. Cl.
CPC ..... *A47L 9/108* (2013.01); *A47L 9/1641* (2013.01); *A47L 9/165* (2013.01); *A47L 9/1683* (2013.01); *A47L 9/322* (2013.01)

(58) Field of Classification Search
CPC ..... A47L 9/1683; A47L 9/20; A47L 9/108; A47L 9/1641; A47L 9/165; A47L 9/322
(Continued)

(56) References Cited

U.S. PATENT DOCUMENTS 6,625,845 B2 9/2003 Matsumoto et al.
11,612,289 B2 3/2023 Yang et al.
(Continued)

FOREIGN PATENT DOCUMENTS

CN 1440717 A 9/2003
CN 108065862 A 5/2018
(Continued)

OTHER PUBLICATIONS

Office Action and Search Report issued in Taiwanese Application No. 1091286870 dated May 12, 2021 (5 pages).
(Continued)

*Primary Examiner* — David S Posigian
*Assistant Examiner* — Tyler James McFarland
(74) *Attorney, Agent, or Firm* — Birch, Stewart, Kolasch & Birch, LLP

(57) ABSTRACT

A cleaner includes a housing having an introduction opening through which air is introduced, a filtering unit configured to be mounted in an inner space of the housing, and defining a dust collection space between the filtering unit and an inner surface of the housing, and a cleaning unit configured to surround the filtering unit, and configured to be raised and lowered inside the dust collection space along with a manipulation unit, wherein, when the cleaning unit is in an initial position, at least a portion of the cleaning unit is connected to an air introduction path extending from the introduction opening to form a guide flow path to guide a flow of introduced air.

17 Claims, 20 Drawing Sheets

(58) Field of Classification Search
USPC ..... 15/347, 342, 352
See application file for complete search history.

(56) References Cited

U.S. PATENT DOCUMENTS

| | | | | |
|---|---|---|---|---|
| 2001/0025395 | A1* | 10/2001 | Matsumoto ..... | A47L 9/1683 55/447 |
| 2017/0209011 | A1 | 7/2017 | Robinson et al. | |
| 2017/0332860 | A1 | 11/2017 | Nam et al. | |
| 2018/0132685 | A1 | 5/2018 | Muir et al. | |

FOREIGN PATENT DOCUMENTS

| | | | |
|---|---|---|---|
| JP | 2002-315701 | A | 10/2002 |
| JP | 2005-013312 | A | 1/2005 |
| JP | 2005-58787 | A | 3/2005 |
| JP | 3699679 | B2 | 9/2005 |
| KR | 10-0880492 | B1 | 1/2009 |
| KR | 10-1856504 | B1 | 5/2018 |
| KR | 10-2021922 | B1 | 9/2019 |
| TW | 2017358852 | A | 10/2017 |
| TW | 201936105 | A | 9/2019 |
| WO | WO 2021/066318 | A1 | 4/2021 |

OTHER PUBLICATIONS

PCT International Search Report, dated Dec. 8, 2020, issued in International Application No. PCT/KR2020/010818 (3 Pages).

* cited by examiner 21
40
120
130
35
30
175
151
128
140
176
149'
149
GH
Z

CLEANER

CROSS REFERENCE TO RELATED APPLICATION

The present application is a Divisional of copending application Ser. No. 17/018,302, filed Sep. 11, 2020, which claims the benefit of priority to Korean Patent Application No. 10-2019-0121055, filed Sep. 30, 2019, the entire contents of which are incorporated herein for all purposes by this reference.

TECHNICAL FIELD

The present disclosure generally relates to a cleaner. More particularly, the present disclosure relates to a cleaner which has a cleaning unit capable of compressing dust accumulated inside a dust container without opening the dust container.

BACKGROUND

A cleaner is a device that performs cleaning by suctioning or scraping off dust or foreign matter in the area to be cleaned. Such cleaners may include manual cleaners, which may perform cleaning while being directly moved by a user, and automatic cleaners, which may move automatically to perform a cleaning.

In addition, a manual cleaner may be classified into a canister cleaner, an upright cleaner, a handheld cleaner, and a stick cleaner depending on the type of a cleaner. A handheld cleaner includes a separating device that separates waste and dust from an air stream.

The separating device includes a centrifuge that generates one or more cyclones. The centrifuge includes a first cyclone provided with a dust collector having a wall. The dust collector is arranged at a lower side of the first cyclone, and the dust collector may be opened and closed by a base thereof (a lower cover). The base may be rotated on a hinge and may allow the dust collector to be opened and closed.

A filter part having multiple through holes and forming a sort of cover may be provided inside the first cyclone. A second cyclone may communicate with the first cyclone through the filter part. Air inside the first cyclone may pass through the filter part, and then flow to the second cyclone. In this case, while the air passes through the through holes of the filter part, dust contained in the air may block the through holes of the filter part. As the blocking of the through holes increases, the air may not efficiently flow, and the performance of the cleaner may deteriorate.

Accordingly, a user is required to periodically clean the filter part. To this end, the user is required to open the dust collector by rotating the base, which is the lower cover, to reach the filter part in order to clean the filter part. Accordingly, it may not be easy for the user to clean the filter part.

In addition, in the prior art, dust separated from the air stream in the first cyclone and the second cyclone falls downward, and accumulates at the upper side of the base. When the cleaner stops working, the separated dust is stored in a low density state in the dust collector. That is, the dust separated by the first cyclone occupies large volume compared to weight thereof. Accordingly, although there is still sufficient free space inside the dust collector, the dust in a dust container must be emptied frequently to maintain dust collection performance thereof.

To solve this, technologies in which a compression member (a cleaning part) that can compress dust accumulated in a dust collection part is mounted inside the dust collection part, and the dust is compressed by lowering the compression member from the outside without opening the base are disclosed in Japanese Patent No. 3699679 and US Patent Application Publication No. 2018-0132685. The compression member is mounted to surround the filter part, can scrape off dust on the filter part while moving toward the base, can compress dust accumulated in the dust collection part, and may be restored to an initial position thereof by an elastic force of an elastic member such as a spring.

However, the compression member disclosed in such prior art has a raising/lowering structure, and dust may easily accumulate on the upper portion thereof. In particular, dust may be accumulated on a connection part located between the compression member and a manipulation lever manipulating the compression member. In this case, due to the accumulated dust, the compression member may not be restored to an initial position thereof.

Accordingly, dust is accumulated on the upper portion of the compression member because (i) a portion of air introduced during the use of a cleaner flows to a gap between the compression member and the inner surface of the dust container and is accumulated on the connection part located between the compression member and the manipulation lever, and (ii) when the compression member is raised or lowered, dust contained in the dust container falls to the upper side of the compression member, and is accumulated on a connection part between the compression member and a handle.

When dust is accumulated on the upper portion of the compression member, including the connection parts, and is compressed in the process of the raising and lowering of the compression member, the accumulated dust may interfere with the compression member due to the thickness of the compressed dust, and thus the compression member may not be restored to the initial position thereof. When the compression member is not restored to the initial position, the air cyclone flow of a cleaner is interrupted, which deteriorates the performance of the cleaner.

Of course, when the upper portion of the compression member is periodically cleaned, the dust may be removed. However, when the dust container is opened, the upper portion of the compression member is not directly exposed since the upper portion is located at the inside of the dust container. Accordingly, since the compression member must be completely removed from the dust container, cleaning of the compression member is difficult.

In addition, a gap between the compression member and the inner surface of the dust container may be decreased such that the introduced air does not flow to the gap between the compression member and the inner surface of the dust container. In this case, the raising and lowering of the compression member may be interrupted by friction between the compression member and the dust container, so a large force may be required to raise and lower the compression member. Furthermore, when the gap between the compression member and the inner surface of the dust container is decreased, the flow path of the introduced air may be blocked, and thus the efficient air flow in the cyclone may be interrupted.

Furthermore, the conventional compression member is connected to a manipulation lever protruding from the outer part of a cleaner such that the compression member is manipulated at the outer part. A large load may be focused on a connection part connecting the manipulation lever to the compression member and the surrounding portion thereof, so the compression member may be easily deformed or damaged. When the surrounding portion of the connection part of the compression member is deformed, the surrounding portion interferes with components inside the cleaner, and the efficient raising and lowering of the compression member may be interrupted.

SUMMARY

Accordingly, keeping in mind the above problems occurring in the related art, the present disclosure provides a cleaner having a cleaning unit securing free space by compressing dust accumulated inside a dust container of the cleaner such that dust may be prevented from being accumulated on the upper portion of the cleaning unit, particularly, on the upper portion of a connection bracket of the cleaning unit connected to a manipulation unit.

In addition, the present disclosure provides a cleaner, wherein, although dust is accumulated on the upper portion of the cleaning unit, the accumulated dust may be naturally removed during the use of a cleaner.

Furthermore, the present disclosure provides a cleaner, wherein the strength of a connection part connecting the cleaning unit and a manipulation unit located at the outside thereof to each other may be increased by reinforcement so that the cleaning unit may not be easily deformed.

In order to achieve the above objectives, according to one aspect of the present disclosure, a cleaner may be provide including: a cleaning unit provided inside a housing, the cleaning unit raising and lowering while surrounding a filtering unit. At least a portion of the cleaning unit at an initial position may be connected to an air introduction path such that the cleaning unit has a guide flow path guiding an air flow. In addition, a guide fence may be provided in the cleaning unit along the outer edge of the cleaning unit. The guide fence may face the inner surface of the housing, and may form the guide flow path by extending along the inner surface of the housing. Accordingly, a path in which the introduced air flows to the upper side of the cleaning unit or the rear side of the cleaning unit through a gap between the housing and the cleaning unit may be blocked.

In addition, the front portion of the guide fence may extend up to a position closer to an introduction opening of the housing than an intersection of the air introduction path and the guide flow path of the cleaning unit. Accordingly, most of the introduced air may be blocked by the guide fence before reaching the gap between the cleaning unit and the housing. Accordingly, the introduced air may be securely prevented from being introduced through the gap between the cleaning unit and the housing.

Furthermore, a front surface part of the guide fence may be formed in the front portion of the guide fence directed toward the introduction opening. The degree of protrusion of the front surface part toward an air introduction part may be formed to be different along the raising/lowering direction of the cleaning unit. Accordingly, a curved surface or a stepped surface having a shape of an inclining surface formed on the front surface part of the guide fence may naturally induce dust contained in the air to a bottom of a dust collection space, and may prevent large particles of foreign matter from blocking the front portion of the guide fence or being held between the guide fence and the inner surface of a dust container.

In addition, a connection bracket may be provided in the cleaning unit, and may be connected to a manipulation unit configured to raise and lower the cleaning unit. A connecting plate may be provided in the vicinity of the connection bracket. The connecting plate may extend in the raising/lowering direction of the cleaning unit. In this case, a blocking wall may extend from the connecting plate in a direction opposite to the direction of the air flow formed along the guide flow path. Accordingly, the gap between the cleaning unit and the housing in the vicinity of the connection bracket, on which dust may easily be accumulated, may further be reduced, thereby preventing the dust from being accumulated on the upper surface of the connection bracket.

Furthermore, the connection bracket connected to the manipulation unit may protrude from the cleaning unit. A discharge inclining surface having a height that gradually decreases toward the bottom of the dust collection space may be formed on the upper surface of the connection bracket relative to the raising/lowering direction of a raising/lowering direction of the cleaning unit. Such a discharge inclining surface may naturally allow dust which sits on the upper surface of the connection bracket to slide downward, thereby discharging the dust before the dust is accumulated thereon and is compressed.

In addition, in a portion adjacent to a raising/lowering channel over which the connection bracket of the connecting plate raises and lowers, a filter rib may protrude from at least one side of the inner surface of the housing or the outer surface of the connecting plate facing the inner surface toward a side opposite to the filter rib. The filter rib may extend along the raising/lowering direction of the connection bracket and may reduce the gap between the inner surface of the housing and the outer surface of the connecting plate.

Meanwhile, a cleaning ring may be provided on the lower portion of a cleaning body constituting the cleaning unit, the cleaning ring cleaning a filter surface by being in contact with the filter surface in the process of the raising and lowering of the cleaning body. The cleaning ring may be formed in the shape of a flexible rubber on the end portion of the cleaning body. Furthermore, the cleaning ring may be formed through double injection so as to be coupled to the cleaning body. The cleaning ring may be made of a thin and flexible material and may be deformed toward the inner surface of the cleaning body due to high temperature in the process of the double injection, or may curl upward in the process of the raising and lowering of the cleaning unit. However, in the present disclosure, a support rib may be formed on a connection part of the cleaning body and the cleaning ring to prevent such a phenomenon.

The support rib may protrude toward the bottom of the dust collection space, and may support the opposite surface of a guide inclination surface of the cleaning ring.

In addition, a connecting plate may extend from the cleaning body of the cleaning unit in the raising/lowering direction of the cleaning unit. The connecting plate may be connected to a manipulation unit so that the manipulation unit and the cleaning unit may operate in cooperation with each other. Accordingly, in the present disclosure, the connecting plate (also, referred to as a connection part) connecting the manipulation unit with the cleaning unit may be secured to have a sufficient width along the raising/lowering direction of the cleaning unit. Accordingly, the connection part on which an external force (a force of raising and lowering the cleaning unit) transmitted from the manipulation unit is focused may be reinforced.

In addition, a reinforcement plate may be correspondingly coupled to the connecting plate, and a connection bracket may be provided in the reinforcement plate to connect to the manipulation unit. That is, the connecting plate may be formed to be sufficiently large in the cleaning unit of the present disclosure, and the reinforcement plate may be correspondingly coupled to the connecting plate. Accordingly, the strength of the connection between the cleaning unit and the manipulation unit maybe the connection part may be more securely reinforced.

In addition, an upper cleaning part may be provided on the upper surface of the cleaning body corresponding to a side opposite to the guide flow path formed by the cleaning unit, the upper cleaning part being formed as a continuous path along a circumferential direction of the cleaning body. An entrance of the upper cleaning part starting at a position adjacent to the introduction opening may be formed at a location higher than an exit of the upper cleaning part. Accordingly, since the height of the upper cleaning part gradually decreases from the entrance toward the exit, dust may be naturally removed by air flowing in the upper cleaning part although dust is accumulated on the upper surface of the cleaning unit.

The cleaner of the present disclosure described above has the following effects.

First, according to the present disclosure, even without opening the dust container, the cleaning unit can compress dust collected in the dust container while moving (lowering) inside the dust collection space. The guide fence may be provided in the cleaning unit to face the inner surface of the dust container (the housing), and can reduce a gap between the guide fence and the inner surface of the dust container. Accordingly, a path in which the introduced air flows to the upper side of the cleaning unit or the rear side of the cleaning unit through the gap between the housing and the cleaning unit can be blocked. Further, the cleaning unit can be prevented from failing to be restored to the initial position thereof due to the dust accumulated on the connection bracket.

Particularly, the front portion of the guide fence of the present disclosure may extend up to a position closer to the introduction opening than the meeting position of the air introduction path and the inner surface of the guide flow path of the cleaning unit. Accordingly, most of the introduced air can be blocked by the guide fence before reaching the gap between the cleaning unit and the dust container. Accordingly, the introduced air can be securely prevented from being introduced to the gap between the cleaning unit and the dust container.

Accordingly, when the introduced air is prevented from remaining on the upper portion of the cleaning unit (or a connection part of the cleaning unit and the manipulation unit) while flowing along the gap between the dust container and the cleaning unit, the cleaning unit can be restored to the initial position thereof. The cleaning unit at the initial position can facilitate the air flow and induce an air cyclone flow, so the performance of the cleaner can be improved.

Additionally, the degree of protrusion of the front portion of the guide fence in the direction of the introduction opening of the present disclosure may decrease downward along the raising/lowering direction of the cleaning unit. Accordingly, the curved surface or the stepped surface, which may have the shape of an inclining surface formed on the front portion of the guide fence, may naturally induce dust contained in the air to the bottom of the dust collection space, and may prevent large foreign matter from blocking the front portion of the guide fence or being held between the guide fence and the inner surface of the dust container.

In addition, the connection bracket connected to the manipulation unit may be provided in the cleaning unit of the present disclosure. The blocking wall may be formed in the vicinity of the connection bracket of the cleaning unit along the direction of the air flow. Accordingly, the gap between the cleaning unit and the dust container located at the vicinity of the connection bracket on which dust may easily be accumulated can be further reduced, and the dust can be prevented from being accumulated on the upper surface of the connection bracket.

Furthermore, the connection bracket connected to the manipulation unit may protrude from the cleaning unit, and the discharge inclining surface may be formed on the upper surface of the connection bracket. Such a discharge inclining surface may naturally discharge dust by downward sliding the dust sitting on the upper surface of the connection bracket before the dust is accumulated thereon and compressed. Accordingly, the cleaning unit can be prevented from failing to be restored to an initial position thereof due to the dust accumulated on the connection bracket, and thus the performance of the cleaner can be prevented from deteriorating.

Additionally, the filter rib may protrude from the dust container of the present disclosure to be located at a position close to the connection bracket. The filter rib may protrude in the direction of the cleaning unit, and may block air from flowing in the direction of the connection bracket along the gap between the dust container and the cleaning unit. Accordingly, dust contained in the air can be prevented from being accumulated on the upper surface of the connection bracket, and the cleaning unit can be restored to the initial position thereof so as to form the air cyclone flow.

In addition, the manipulation unit may be connected to the cleaning unit to raise and lower the cleaning unit. In the present disclosure, for the connecting of the manipulation unit, the connecting plate may be secured with a sufficient width along the raising/lowering direction of the cleaning unit. Accordingly, the connection part on which an external force (a force of raising and lowering the cleaning unit) transmitted from the manipulation unit is focused can be reinforced, to prevent the connection part from being warped or damaged, thereby improving durability of the connection part.

Furthermore, the connecting plate may be formed to be sufficiently large in the cleaning unit of the present disclosure, and the reinforcement plate may be correspondingly coupled to the connecting plate. Accordingly, the strength of the connection between the cleaning unit and the manipulation unit by the connection part can be more securely reinforced.

In addition, in the present disclosure, the upper cleaning part may be provided on the upper surface of the cleaning unit, the upper cleaning part forming a continuous path along the circumferential direction of the cleaning unit. The height of the upper cleaning part may gradually decrease from the entrance thereof toward the exit thereof. Accordingly, the exit of the upper cleaning part may be lower than the entrance of the upper cleaning part. Accordingly, although dust is accumulated on the upper surface of the cleaning unit, the dust can be efficiently removed therefrom by air flowing in the upper cleaning part. Accordingly, although a user does not clean the upper surface of the cleaning unit, the cleaning unit can be prevented from failing to be restored to the initial position thereof due to the dust accumulated on the upper surface of the cleaning unit.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Figure 1:
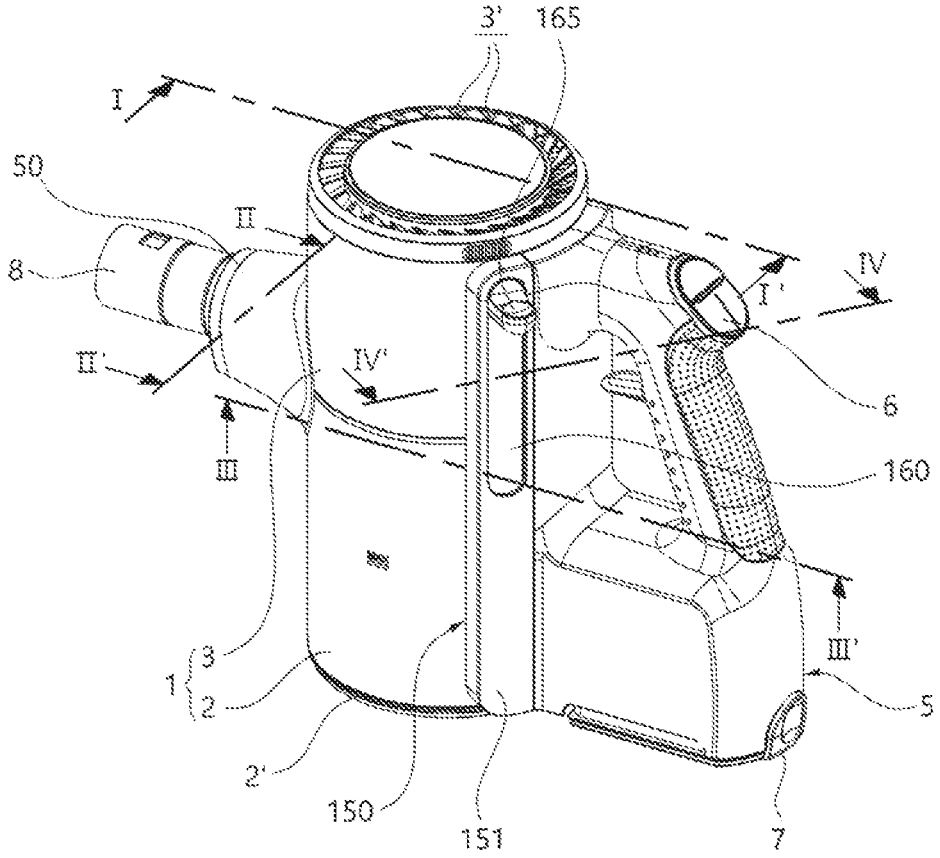
FIG. 1 is a perspective view illustrating the configuration of an example cleaner according an embodiment of the present disclosure.

Hereinafter, some embodiments of the present disclosure will be described in detail with reference to the accompanying drawings. It should be noted that in adding reference numerals to the components of each drawing, the same components have the same reference numerals when possible, even if they are displayed on different drawings. In addition, in describing the embodiments of the present disclosure, when it is determined that a detailed description of a related known configuration or function interferes with the understanding of the present disclosure, the detailed description is to be omitted.

In addition, in describing the components of the embodiments of the present disclosure, terms such as first, second, A, B, a, and b may be used. These terms are only for distinguishing the components from other components, and the nature or order of the components is not limited by the terms. When a component is described as being "connected" or "coupled" to another component, that component may be directly connected to or coupled to another component. However, it should be understood that another component may be "connected" or "coupled" to each component therebetween.

The present disclosure relates to a cleaner, and more particularly, relates to a cleaner which separates dust from air by using a cyclone flow of air. Particularly, the cleaner of the present disclosure may include a cleaning unit 110 capable of compressing dust accumulated inside the dust container by using a manipulation lever at the outside of the of a housing without opening an entrance of a dust container. Hereinafter, the present disclosure is described to be applied to a handheld vacuum cleaner as an example, but may be applied to other types of cleaners such as a canister cleaner.

Figure 2:
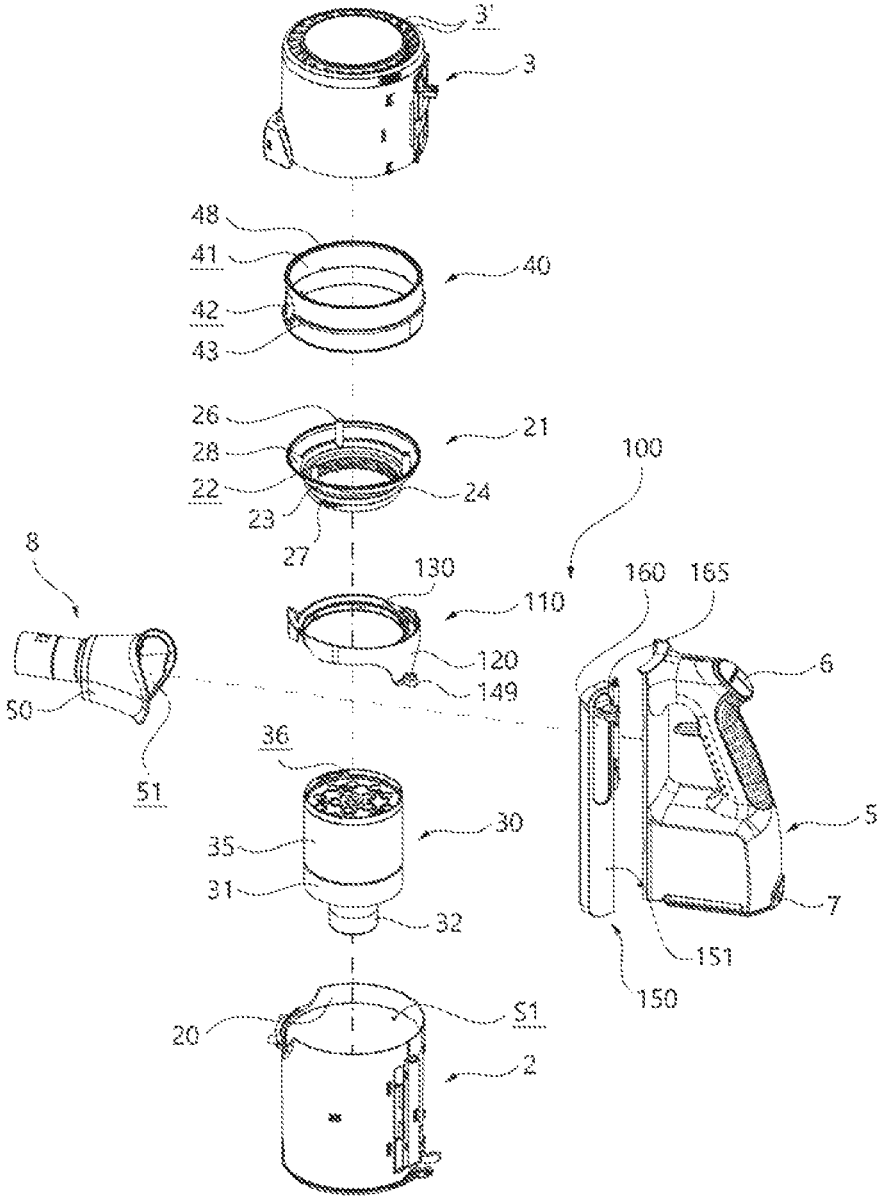
FIG. 2 is an exploded perspective view illustrating example components constituting the cleaner of FIG. 1.

FIG. 1 is a perspective view illustrating the configuration of the cleaner according an embodiment of the present disclosure, and FIG. 2 is an exploded perspective view of components constituting the cleaner. As illustrated in these drawings, first, the housing 1 may constitute the appearance and frame of the cleaner of the present disclosure. In some embodiments, the housing 1 may be mainly divided into a first housing 2 and a second housing 3, and may have an approximately cylindrical shape. Here, the first housing 2 may constitute the dust container. When a lower cover 2' located at a lower side of the dust container is opened, the dust container may be opened. In some embodiments, the first housing 2 and the second housing 3 may be arranged in a vertical direction. Alternatively, the first housing 2 and the second housing 3 may be arranged in a horizontal direction to each other.

An inner space S1 may be provided inside the first housing 2. The cleaning unit 110 and an inner housing 40, including a filtering unit 30 to be described below, may be mounted in the inner space S1. The shapes of the first housing 2 and the second housing 3 are shown by way of example, and may be modified in various ways. A dust collection space S1 may be provided between the inner surface of the first housing 2 and the outer surface of the filtering unit 30. The dust collection space S1 may be regarded as the inner space of the first housing 2. Here, the inner surface 20 of the first housing 2 refers to an inner circumferential surface of the first housing 2 corresponding to an opposite side of the outer surface of the first housing 2 exposed to the outside.

A handle part 5 may be provided at one side of the housing 1. The handle part 5 may be configured to be separated from the housing 1 and may be assembled with the housing 1, or at least a portion of the handle part 5 may be integrated with the housing 1. The handle part 5 may be a portion which a user grasps, and a switch 6 manipulated to be turned on and off may be provided at one side of the handle part 5. In some embodiments, a battery 7 may be mounted at the lower side of the handle part 5 to supply power for the operation of the cleaner.

An introduction opening 8 may be provided at one side of the housing 1. The introduction opening 8 may protrude to the opposite side of the handle part 5, and an introduction space 8' may be provided therein. When the cleaner operates, a suction force generated by a motor unit 10 may be transmitted to the introduction opening 8, and external air having dust may be introduced to the inner space S1 of the cleaner through the introduction opening 8 and the introduction space 8'. In FIG. 1, the introduction opening 8 is illustrated to be short, but various cleaning devices (not shown) may be coupled to the front of the introduction opening 8.

The air having dust is described above, and foreign matter having various sizes may be included in the dust. That is, the dust may include foreign matter of very fine sizes, or foreign matter of various sizes such as hair, sand, or cookie crumbs. Hereinafter, the various foreign matter may be referred to as dust for convenience.

Although described again below, a manipulation unit 150 will be described first for better understanding. As illustrated in FIG. 1, a manipulation housing 151 constituting the manipulation unit 150 may be coupled to the housing 1, and the manipulation lever 160 which may be configured to be raised and lowered may be assembled with the manipulation housing 151. When a user presses a button part 165 of the manipulation lever 160 downward, the cleaning unit 110 to be described below may compress dust contained in the dust collection space S1 located inside the first housing 2 while lowering in the inner space S1 of the cleaner, and at the same time, may clean the filtering unit 30 by scraping down the surface thereof. That is, when a user lowers only the manipulation lever 160 at the outside, even without opening the inner space S1 of the cleaner, dust contained inside the dust collection space S1 may be compressed. Further details regarding the structure of the manipulation unit will be described below.

Figure 3:
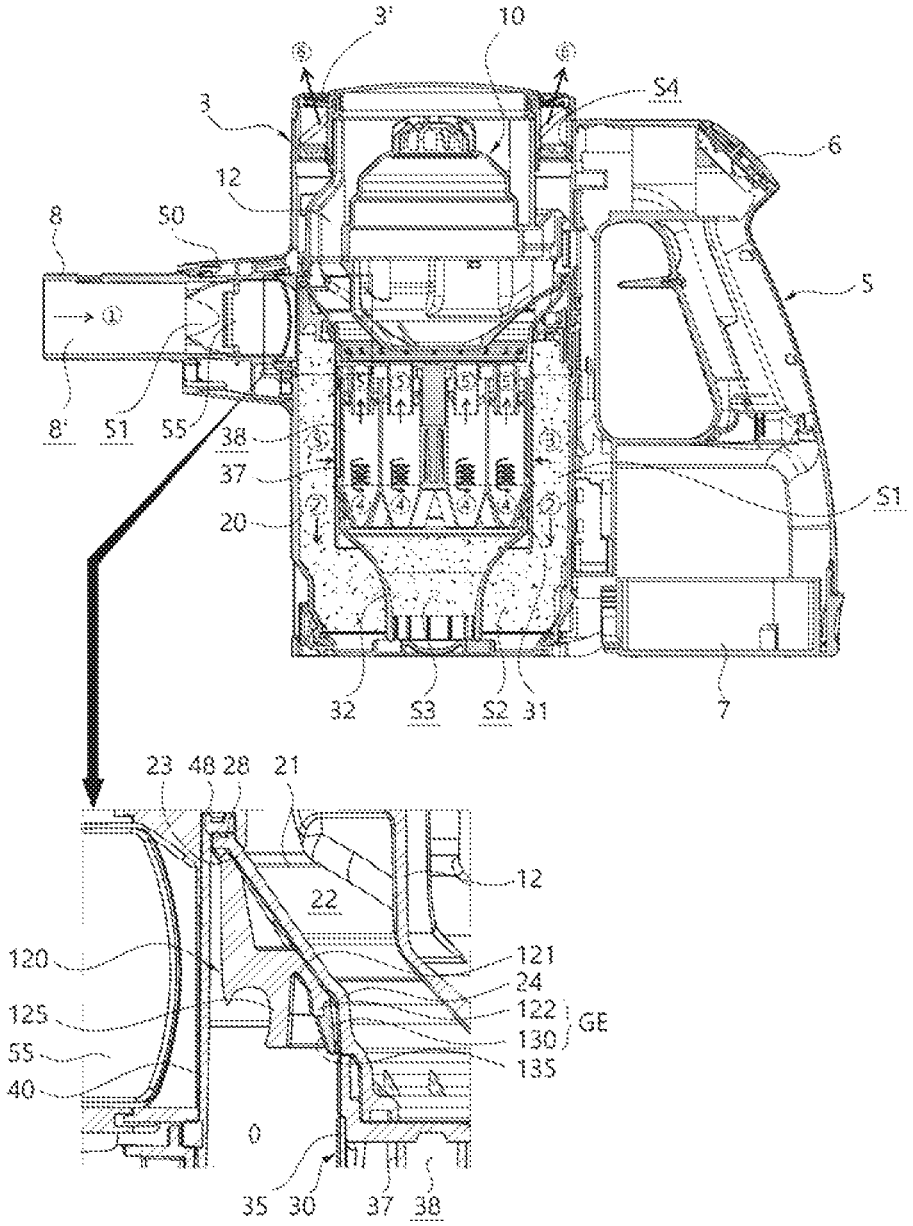
FIG. 3 is a sectional view taken along line I-I' of FIG. 1.

Referring to FIG. 3, a motor unit 10 may be mounted inside the second housing 3. The motor unit 10 mounted inside the second housing 3 may provide the suction force of the cleaner. Although not shown, the motor unit 10 may include an electric motor rotating by receiving power from a battery, and an impeller generating the suction force while rotating with a rotating shaft of the electric motor. Accordingly, the motor unit 10 may be mounted inside the second housing 3, but in FIG. 3, only a motor case 12 in which the motor unit 10 is mounted is illustrated, and the electric motor, the rotating shaft, and the impeller are omitted.

Referring to FIGS. 2 and 3, an air guide 21 may be provided inside the housing 1. The air guide 21 may have the shape of a ring with a width that gradually narrows in a downward direction. The air guide 21 may include and a through hole 22 provided at the center thereof. The outer surface of the air guide 21 may guide the flow of air introduced through an introduction flow path 51 of the introduction opening 8. The outer surface of the air guide 21 may have an inclining shape, and the introduced air may be naturally induced downward.

An air guide surface 23 guiding the flow of air may be provided on the upper portion of the air guide 21 and may have an inclining shape. The diameter of the air guide 21 may gradually decrease toward the bottom of the dust collection space S1, such that the air guide surface 23 is a naturally inclining surface. When the cleaning unit 110 to be described below is located at an initial position (see FIG. 3), the cleaning unit may surround the outer side of the air guide surface 23, and the introduced air may be prevented from flowing through the air guide surface 23. However, when the cleaning unit 110 is moved to the lowered position, the air guide surface 23 may face the introduction flow path 51 communicating with the introduction opening 8, and thus may guide the flow of the introduced air (see FIG. 4).

For reference, the initial position refers to a position at which the cleaning unit 110 moves to a top position and communicates with an air introduction path of the introduction opening 8, and the lowered position refers to a position at which the cleaning unit 110 lowers, compresses dust contained in the dust collection space S1, and scrapes off dust on the outer surface of the filtering unit 30.

A combination end 24 may protrude at the lower side of the air guide surface 23. The combination end 24 may be a part by which the air guide 21 may be assembled with the filtering unit 30 to be described below, and may be correspond to a part protruding more than the lower side of the air guide surface 23 thereto. An assembly key 27 may protrude from the combination end 24. The assembly key 27 may be inserted to an assembly groove 36 of the filtering unit 30, so the assembling of the air guide 21 and the filtering unit 30 to each other may be performed. The assembly key 27 and the assembly groove 36 may be assembled to each other in a rotating manner.

An assembly boss 26 may protrude from the air guide 21 by extending in a direction of the upper side thereof, that is, in a direction of the second housing 3. The assembly boss 26 may allow the air guide 21 to be assembled even with the motor case 12 located inside the second housing 3. The assembly boss 26 may be assembled with the motor case 12 by a fastener such as a bolt.

A holding end 28 may be formed on the edge of the upper end of the air guide 21. The holding end 28 may be formed by surrounding the edge of the upper end of the air guide 21. When the air guide 21 is assembled with the inner housing 40 to be described below, a corresponding holding portion 48 located on an edge of the inner side of the inner housing 40 may be held in the holding end 28. Such a configuration can be clearly seen in the enlarged view of FIG. 3.

The air guide 21 may be assembled with the filtering 30. A cyclone part may be provided inside the filtering unit 30. More precisely, In some embodiments, a first cyclone part (a reference numeral not assigned) and a second cyclone part 37 may be provided inside the cleaner. The second cyclone part 37 may be provided inside the filtering unit 30. Dust may be more effectively filtered due to the provision of the first cyclone part and the second cyclone part 37. In some embodiments, the first cyclone part may not be provided as a separate component, but may be formed by the inner surface 20 of the housing 1, the air guide 21, and the cleaning unit 110.

The filtering unit 30 may be mounted at the center of the inner space S1 of the first housing 2, and may define the dust collection space S1 between the filtering unit 30 and the inner surface of the first housing 2. The dust collection space S1 may be defined at the lower side of the inner space S1 of the first housing 2, and may be regarded as a first dust storage part S2 in which dust is accumulated.

In this case, the second cyclone part 37 may be located inside the first cyclone part such that the size of the housing 1 is minimized. Referring to FIG. 3, the second cyclone part 37 may include multiple cyclone bodies arranged in parallel. Air may flow through a path 38 of each of the cyclone bodies. In the path 38, a centrifugal force may cause air to rise, and foreign matter to fall downwards.

A dust guide 31 may be provided at the lower side of the second cyclone part 37. The dust guide 31 may include a guide body 32 having a width that gradually decreases toward the lower side thereof like a kind of hopper, and a second dust storage part S3 may be provided inside the guide body 32 to store dust separated from the air in the second cyclone part 37. The second dust storage part S3 may be formed at the center of the housing 1 and may be separated from the first dust storage part S2 by the guide body 32.

Referring to FIG. 3, the air flow in the cleaner will be described. While air (flowing in the direction of arrow ①) and dust introduced through the introduction opening 8 by the operation of the motor unit 10 flow along the inner circumferential surface of the first cyclone part, the air and dust may be separated from each other.

The dust separated from the air may flow downward (as shown by the direction of arrow ②), and may be stored in the first dust storage part S2. The air separated from the dust may flow to the second cyclone part 37. In this case, the air may flow through the filtering unit 30 (as shown by arrow ③). In the process of passing through the filtering unit 30, the air may pass through a mesh net 35 located on the outer surface of the filtering unit 30. In the process, dust having large particles may also be filtered through narrow holes formed in the mesh net 35.

In addition, the air flowing to the second cyclone part 37 may be once again separated from the dust by centrifugal force. The dust separated from the air in the second cyclone part 37 may move downward, and be stored in the second dust storage part S3 (as shown by arrow ④).

Meanwhile, air separated from the dust in the second cyclone part 37 may be discharged from the second cyclone part 37 and rise toward the motor unit 10 (in the direction of arrow ⑤). The risen air may pass through a pre-filter (not shown) located at the outer side of the motor unit 10. Air passing through the pre-filter may pass through the motor unit 10, and then pass through a HEPA filter located at the discharge space S4 of the second housing 3, and be discharged to the outside (in the direction of arrow ⑥) through an air discharge opening 3'. In some embodiments, at least one of the pre-filter or the HEPA filter may be omitted.

In this case, the dust separated from the cyclone part may be accumulated in the first dust storage part S2 and the second dust storage part S3. The weight of the dust is light, so when a user opens the first housing 2 (which is the dust container), the dust may scatter to the outside. That is, the dust collected inside the dust container may not be brought together into one lump, and may be difficult to be emptied. In some embodiments, to solve such a problem, a cleaning module 100 may be provided. The cleaning module 100 may include the cleaning unit 110 compressing dust and the manipulation unit 150 for moving the cleaning unit 110.

Figure 4:
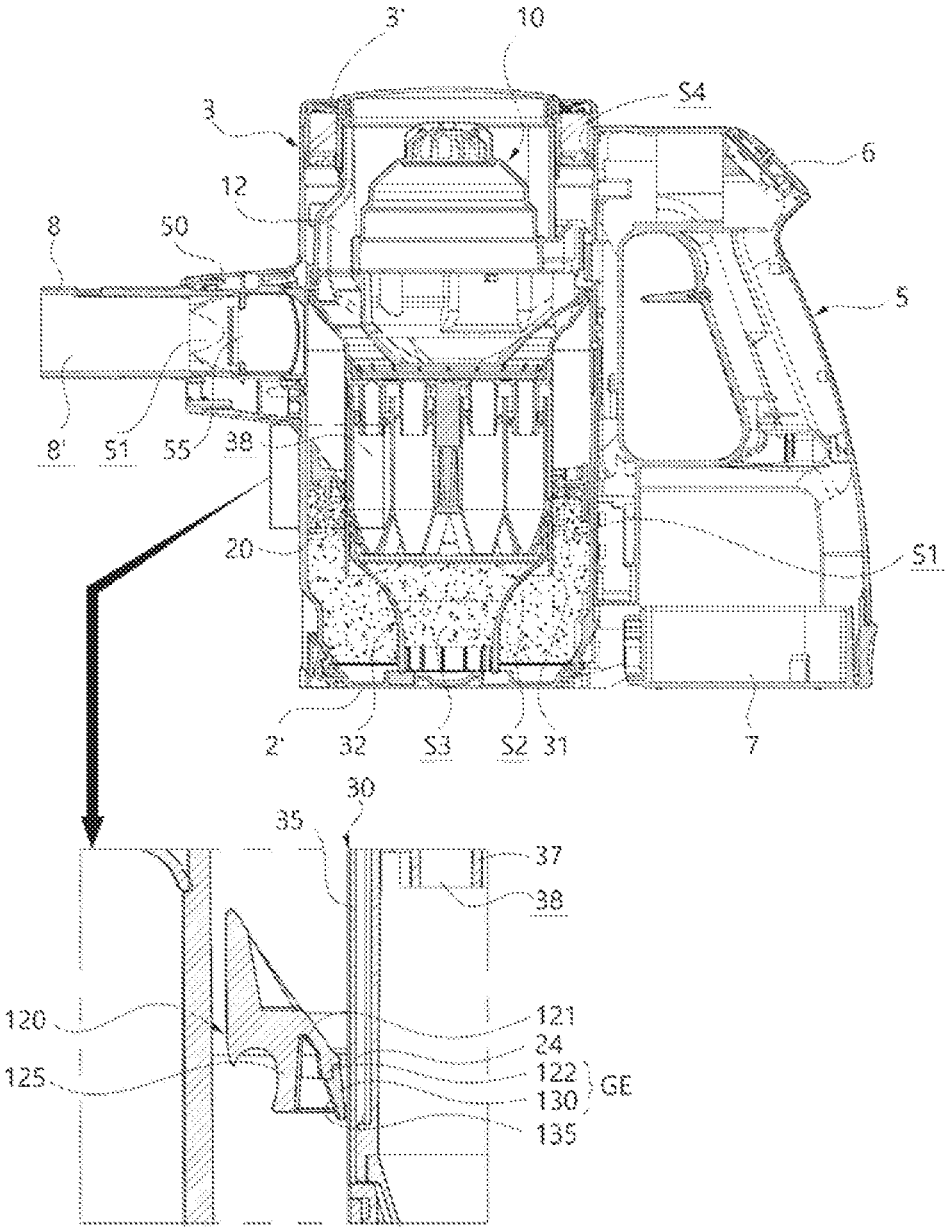
FIG. 4 is a sectional view illustrating a lowered state of an example cleaning unit.

For reference, in FIG. 4, the cleaning unit 110 is illustrated to lower and scrape off dust on the outer surface of the filtering unit 30. Referring to FIG. 4, the cleaning body 120 and a cleaning ring 130 constituting the cleaning unit 110 are lowered toward the lower portion of the dust collection space S1. In the process of the lowering of the cleaning unit 110, the cleaning unit 110 may compress the dust, and the cleaning ring 130 may push down the dust on the outer surface of the filtering unit 30. As illustrated in FIG. 4, dust of the upper portion of the inner space is illustrated to be in a compressed state by being pressed down by the cleaning body 120 and the cleaning ring 130. These components will be described again below.

Referring back to FIG. 2, the mesh net 35 may be provided on the outer surface of the filtering unit 30. The mesh net 35 may be mounted to the filtering unit 30 so as to surround the outer surface thereof, and may function to filter dust contained in air introduced to the second cyclone part 37 from the dust collection space S1. To this end, multiple holes may be formed in the mesh net 35. When the cleaner is used, the holes may be completely or partially blocked by dust and thus may require cleaning. The cleaning of such a mesh net 35 may be performed by the cleaning unit 110.

The inner housing 40 may be mounted to the upper portion of the filtering unit 30. The inner housing 40 may be provided in the inner space S1 of the housing 1. In some embodiments, a portion of the inner housing 40 may be arranged inside the first housing 2, and the remaining portion thereof may be arranged inside the second housing 3. The inner housing 40 may have the shape of an approximate circular frame, and may surround the outer sides of the air guide 21 and the cleaning unit 110 when mounted inside the inner space S1.

A through-space 41 open in an upward and downward direction may be defined at the center of the inner housing 40. The air guide 21 and the cleaning unit 110 may be located in the through-space 41. As illustrated in FIG. 3, the cleaning unit 110 at the initial position may be located inside the inner housing 40, and the air guide 21 may be located closer to a center of the cleaner than cleaning unit 110. The inner housing 40 may surround the cleaning unit 110 at the initial position and may to guide at least a portion of the cleaning unit 110 during the raising and lowering of the cleaning unit 110.

Figure 16:
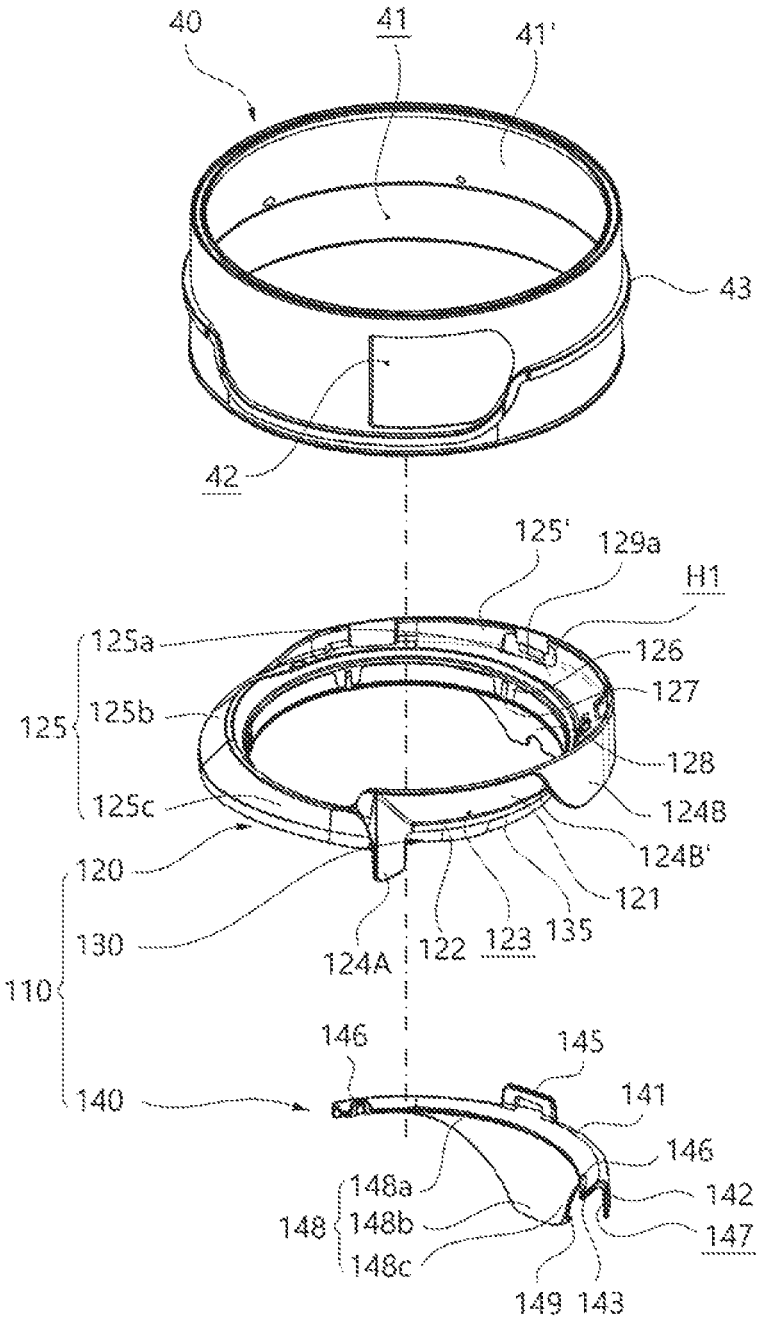
FIG. 16 is an exploded perspective view of each of the components of FIG. 14.

A communication window 42 may be open at one side of the inner housing 40. The communication window 42 may be a portion connecting the introduction flow path 51, which is connected to the introduction opening 8, to the inner space S1. In some embodiments, as shown in FIG. 16, the communication window 42 may have an approximate "D" shape. The introduction opening 8 and the cleaning unit 110 located at an inner side thereof may communicate with each other by the communication window 42.

A sealing member 43 may be provided on the outer surface of the inner housing 40. The sealing member 43 may be provided along the outer surface of the inner housing 40 and may limit an air flow between the upper portion and the lower portion of the sealing member 43 relative thereto. That is, the sealing member 43 may induce air to flow only along a formed path. For reference, the inner housing 40 may be omitted, or the first housing 2 or the second housing 3 may be intentionally provided.

Referring to FIG. 2, an introduction housing 50 may be connected to the introduction opening 8. The introduction housing 50 may be assembled with the introduction opening 8, for example by surrounding the introduction opening 8, or may be provided integrally to the introduction opening 8. The introduction housing 50 may connect the introduction opening 8 to the housing 1 and may be larger in diameter than the introduction opening 8. The introduction flow path 51 communicating with the introduction space 8' of the introduction opening 8 may be provided inside the introduction housing 50.

Next, the cleaning module 100 will be described below. The cleaning module 100 may generally include the cleaning unit 110 and the manipulation unit 150 allowing the cleaning unit 110 to be operated. As illustrated in FIG. 2, the cleaning unit 110 and the manipulation unit 150 may be separate components and may be assembled with each other to constitute one cleaning module 100. At least some components, including the manipulation lever 160 of the manipulation unit 150, may protrude to the outside of the housing 1 and a user may use the cleaning module 100 from the outside of the housing 1.

Figure 5A:
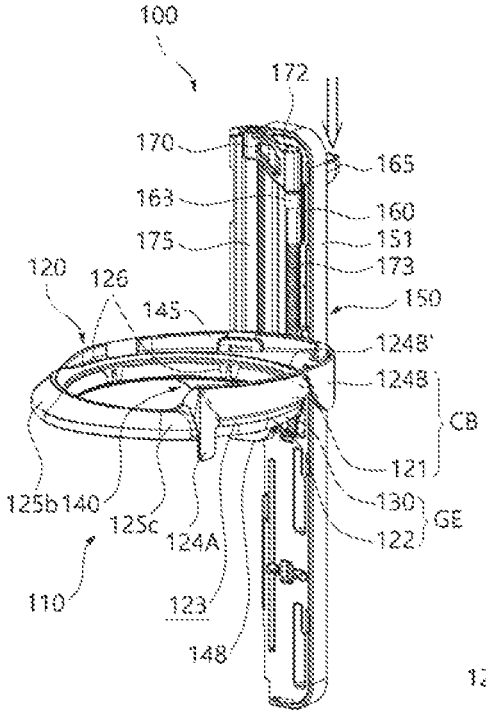
FIGS. 5A and 5B are perspective views illustrating an example cleaning unit and manipulation unit with the cleaning unit in an initial position and a lowered position, respectively.
Figure 5B:
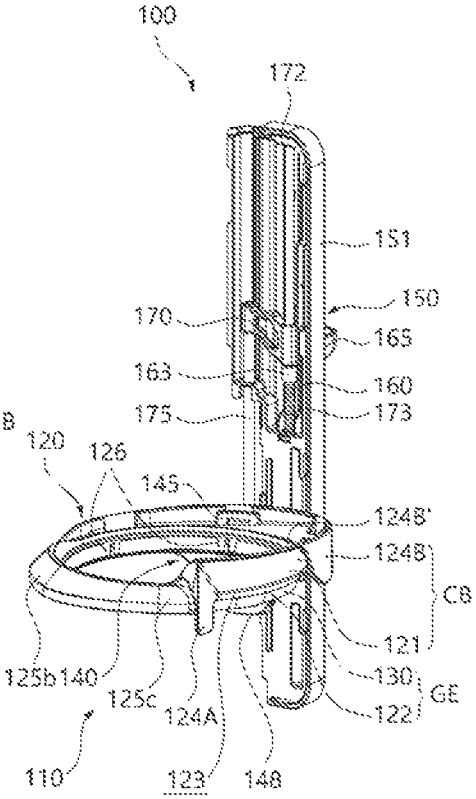

FIGS. 5A and 5B illustrate an example cleaning module 100 according to some embodiments of the present disclosure. As illustrated in FIGS. 5A and 5B, the manipulation unit 150 constituting the cleaning module 100 may be provided along the raising/lowering direction of the cleaning unit 110, and the cleaning unit 110 may be mounted in a direction orthogonal to the manipulation unit 150. The cleaning unit 110 may extend in the form of a cantilever from the manipulation unit 150. Accordingly, the cleaning unit 110 may become eccentric while raising and lowering. When the cleaning unit 110 is eccentric, the filtering unit 30 located at the center thereof may interfere with the cleaning unit 110, so the raising and lowering of the cleaning unit 110 may be interrupted. The structure of a gap maintenance rib 127 for solving this problem is described below.

FIG. 5A illustrates the state of the cleaning unit 110 located at the initial position which is a first position thereof, and FIG. 5B illustrates the state of the cleaning unit 110 located at a lowered position thereof which is a second position thereof after the cleaning unit 110 lowers. While cleaning unit 110 is moving from the initial position to the lowered position, the cleaning unit 110 may compress dust contained in the dust collection space S1 and may scrape dust off of the mesh net 35 in a downward direction. As used herein, a lowered state may not necessarily refer to the fully lowered state, and may include any state in which the cleaning unit 110 is lower relative to the initial state. For example, as shown in FIG. 4, the cleaning unit 110 may be considered to be in a lowered state although it is not at the lowest position. In FIG. 5B, the cleaning unit 110 is located at the lowered position by moving relatively further downward.

Referring to the structure of the manipulation unit 150, the manipulation housing 151 of the manipulation unit 150 may be coupled to the outer surface of the housing 1 described above, and may extend in a vertical direction from the first housing 2 to the second housing 3. Two or more rails may be provided in the manipulation housing 151, which may include a fixed rail 172 and a movable rail 175. The fixed rail 172 and the movable rail 175 may be mounted in longitudinal directions (the vertical directions) of the manipulation housing 151. The fixed rail 172 may be in a fixed state, and the movable rail 175 may raise and lower together with the cleaning unit 110. In some embodiments, each of the fixed rail 172 and the movable rail 175 may have the shape of a thin and long rod.

The manipulation lever 160 may be connected to the fixed rail 172, and may raise and lower along fixed rail 172. The button part 165 may be provided in the manipulation lever 160. The manipulation lever 160 may be located inside the manipulation housing 151 and may not be exposed to the outside, but the button part 165 may be exposed to the outside of the manipulation housing 151 such that a user may press the button part 165. When the user presses the button part 165, the manipulation lever 160 may lower the movable rail 175 while lowering along the fixed rail 172.

More precisely, a connection block 170 may be connected to the button part 165. The connection block 170 may be located at the inner side of the manipulation housing 151 and may raise and lower along the button part 165. The connection block 170 may be fitted over the fixed rail 172 so as to raise and lower along fixed rail 172 and may be connected to the movable rail 175. Accordingly, the connection block 170, together with the button part 165, may raise and lower along the fixed rail 172, and in the process, may raise and lower the movable rail 175. As illustrated in FIG. 5A, the connection block 170 may be mounted in a direction across the fixed rail 172 and the movable rail 175. Reference numeral 163 is a press end coupled to the connection block 170, and may be a part compressing a spring 173 during the lowering of the connection block 170.

Reference numeral 173 refers to the spring 173. The spring 173 may be assembled with the fixed rail 172 by being fitted thereover and may be located at a position lower than a position of the manipulation lever 160. The spring 173 may be compressed in as the connection block 170 is lowering together with the manipulation lever 160. When a force of pressing the button part 165 is released, the spring 173 may restore the manipulation lever 160 to an initial position, that is, to the state shown in FIG. 5A, while the spring 173 is restored to an initial shape. In some embodiments, the spring 173 may be omitted.

The movable rail 175 may be mounted to the manipulation housing 151 and be connected to the manipulation lever 160, and thus may raise and lower together with the manipulation lever 160. One end of the movable rail 175 may be connected to a connecting plate 128 (hereinafter, also referred to as a connection part) of the cleaning unit 110, as described below. Accordingly, the movable rail 175 and the cleaning unit 110 may raise and lower together. The movable rail 175 and the connection part of the cleaning unit 110 may be parts on which a load is focused due to an external force, and thus may be easily damaged or deformed. Structures of the connecting plate 128 and a reinforcement plate 140 for solving this problem will be described in detail below.

Figure 6A:
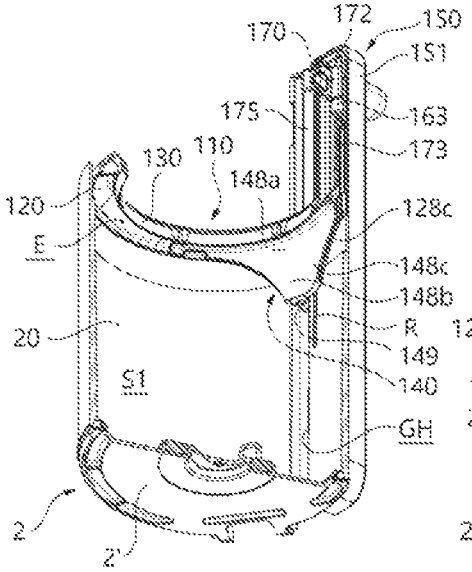
FIGS. 6A and 6B are perspective views illustrating the raising of and lowering, respectively, of an example cleaning unit by a manipulation unit mounted to a housing.
Figure 6B:
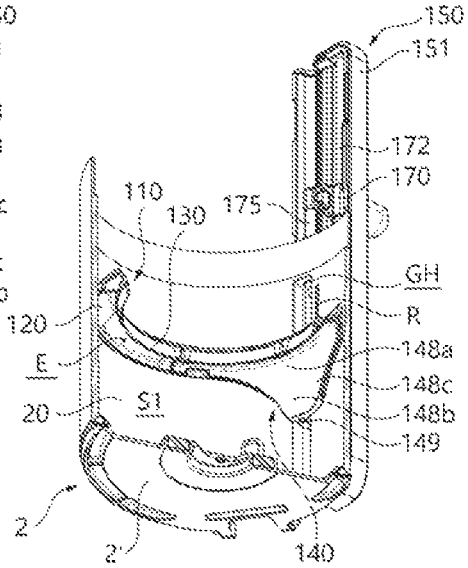

In FIGS. 6A and 6B, the manipulation unit 160 is illustrated to be mounted to the housing 1. FIG. 6A illustrates a state in which the cleaning unit 110 is located at the initial position, and FIG. 6B illustrates the state in which the cleaning unit 110 is located at the lowered position. A raising/lowering channel GH may be provided on the inner surface of the housing 1. The raising/lowering channel GH may extend on the inner surface 20 of the housing along the lifting/lowering direction of the cleaning unit 110, and may be configured as a protrusion from the inner surface 20 toward the inside thereof.

A connection bracket 149 provided in the cleaning unit 110 may be fitted over the raising/lowering channel GH, and may be connected to the movable rail 175 of the manipulation unit 150 while being fitted over the raising/lowering channel GH. As described again below, the connection bracket 149 may be provided in the reinforcement plate 140 reinforcing the connecting plate 128 of the cleaning body 120 constituting the cleaning unit 110.

A filter rib R may protrude from the inner surface 20 of the housing 1. The filter rib R may extend along the raising/lowering direction of the connection bracket 149 and may function to reduce the gap between the inner surface 20 of the housing 1 and the outer surface of the connecting plate 128. The filter rib R may be provided along a portion of the entire height of the inner surface 20 of the housing 1. In some embodiments, the filter rib R may be formed to have the same length as or length longer than the length of the raising/lowering section of the connection bracket 149.

Of course, the filter rib R may be formed to have length shorter than the length of the raising/lowering section of the connection bracket 149. For example, at the initial position of the cleaning unit 110 of the cleaner by which cleaning is performed while outside air is introduced, the filter rib R may be formed in the vicinity of the connection bracket 149.

In this case, the entire length of the filter rib R may be shorter than the length of the raising/lowering section of the connection bracket 149.

The filter rib R may be provided to be adjacent to the raising/lowering channel GH, and may be provided at a position close to the entrance Ea of a guide flow path E, which guides the air flow, of the opposite sides of the raising/lowering channel GH. Accordingly, the filter rib R may prevent a portion of air flowing along the guide flow path E from being introduced to the gap between the inner surface 20 of the housing 1 and the cleaning unit 110, and thus may prevent dust contained in the air from being introduced to the inside of the raising/lowering channel GH and the connection bracket 149.

As illustrated in FIGS. 6A and 6B, the filter rib R may be formed along a straight line section, but may be slanted in an inclining direction. The filter rib R may be formed in shapes other than a straight line. For example, the filter rib R may be formed to have a U shape to surround the vicinity of the raising/lowering channel GH over which the connection bracket 149 is fitted, and at least two filter ribs may be provided parallel to each other. The function of such a filter rib R is described again below.

Figure 21:
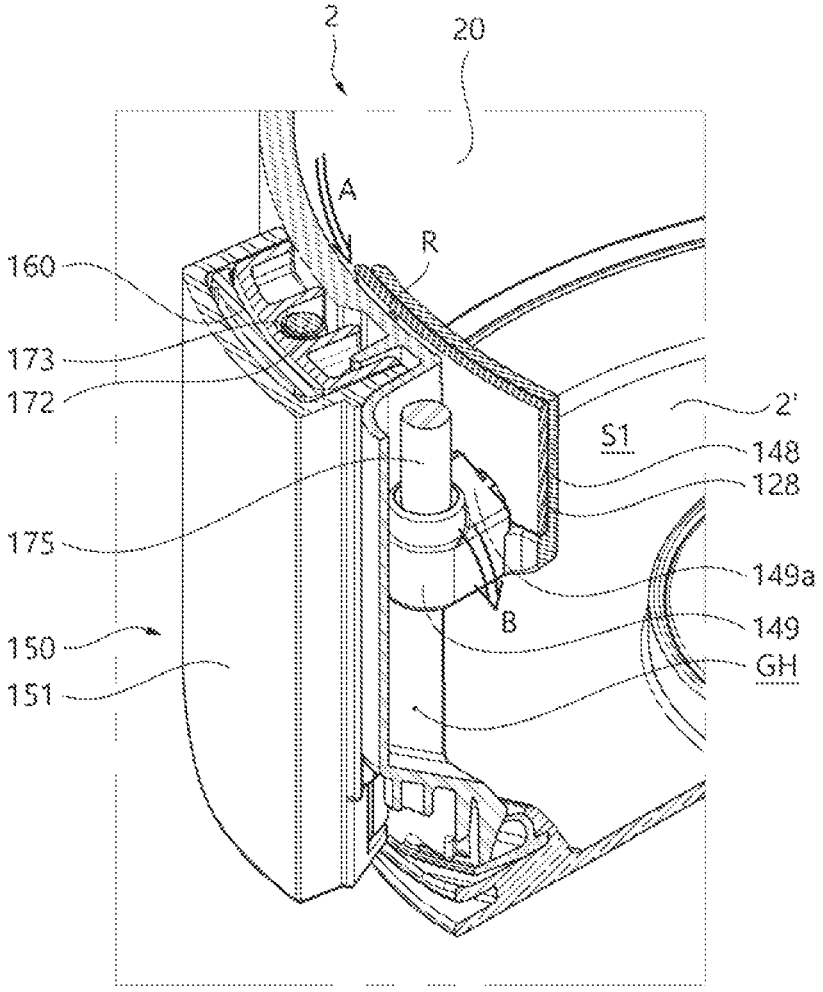
FIG. 21 is a cross-sectional view taken along line IV-IV' of FIG. 1.

As shown in FIG. 21, the cross section of the filter rib R may gradually decrease in width toward the outer surface of the connecting plate 128. In some embodiments, the cross section of the filter rib R may be semicircular. Accordingly, when the cross section of the filter rib R gradually decreases in width toward the outer surface of the connecting plate 128, although the connecting plate 128 and the filter rib R interfere with each other in the process of the raising and lowering of the cleaning unit 110, the connecting plate 128 may be in linear contact with the filter rib R, so friction therebetween may be reduced.

Figures 7A, 7B, 7C:
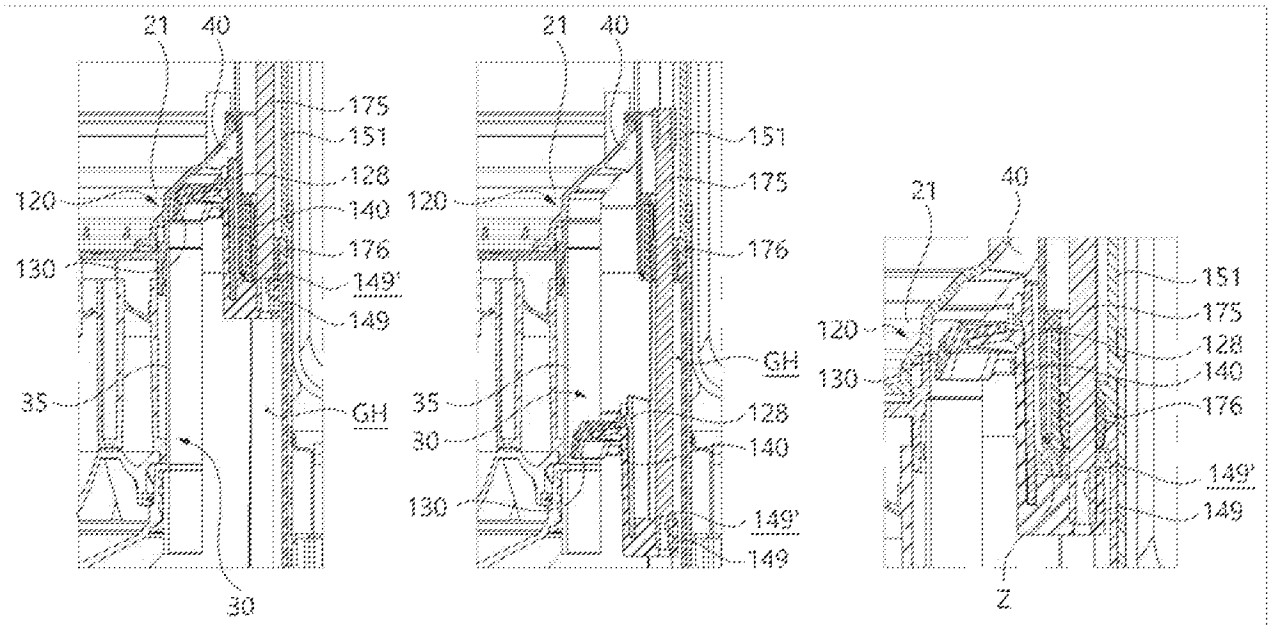
FIGS. 7A and 7B are sectional views illustrating the raised and lowered state, respectively, of an example cleaning unit and manipulation unit.
FIG. 7C is a sectional view illustrating an example cleaning unit which is not completely restored to an initial position thereof.

FIGS. 7A, 7B, and 7C illustrate the raising and lowering of the cleaning unit 110 and the manipulation unit 150. FIG. 7A illustrates the cleaning unit 110 located at the initial position and FIG. 7B illustrates the cleaning unit 110 located at the lowered position. As illustrated above, the cleaning body and the cleaning ring constituting the cleaning unit 110 may raise and lower by operating in cooperation with the manipulation unit 150. At the initial position, the cleaning unit 110 may be completely raised by an elastic member (e.g., spring 173) and may be in close contact with the air guide 21.

In addition, when the cleaning unit 110 lowers, the cleaning unit 110 may be separated from the air guide 21, and may pass by the surface of the filtering unit 30 while moving to the lower side of the dust collection space S1. In the process, the cleaning unit 110 may compress dust contained in the dust collection space S1 and may scrape off dust on the mesh net 35 located on the outer surface of the filtering unit 30.

As illustrated in FIG. 7B, the cleaning unit 110 located at the lowered position may be raised again and may be automatically restored to the initial position by the elastic member (e.g., spring 173) of the manipulation unit 150. However, the cleaning unit 110 may not be able to be restored to the initial position. For example, this may occur because (i) when a cleaner is used with the cleaning unit 110 located at the initial position thereof, a portion of the introduced air flows to the gap between the cleaning unit 110 and the inner surface 20 of the housing 1, and is accumulated on the connection bracket 149, and (ii) during the raising and lowering of the cleaning unit 110, dust contained in the dust collection space S1 falls on the cleaning unit 110 and is accumulated on the connection bracket 149.

In this case, the cleaning unit 110 may not be restored to the initial position, as illustrated in FIG. 7C. When dust Z accumulated on the upper surface of the connection bracket 149 is compressed, the dust may have a predetermined height. Accordingly, the cleaning unit 110 may not be restored to the initial position by the height of the dust. In the disclosed embodiments, such a problem may be prevented by several structures including the filter rib R, which will be described below.

Next, the cleaning unit 110 will be described again. The cleaning unit 110 may be mounted to surround the filtering unit 30, and may be raised and lowered inside the dust collection space S1 by the manipulation unit 150. In this case, at least a portion of the cleaning unit 110 located at the initial position thereof may communicate with the air introduction path extending from the introduction opening 8 and thus the cleaning unit may function to guide the flow of the air. Here, the connection of the portion of the cleaning unit 110 and the air introduction path to each other may mean that at least the portion of the cleaning unit 110 is located in the air introduction path. The air introduction path may be regarded to include the introduction space 8' of the introduction opening 8 and the introduction flow path 51 of the introduction housing 50.

That is, the cleaning unit 110 (i) may function to guide the flow of the introduced air at the initial position, (ii) to compress dust contained in the dust collection space S1 in the process of lowering, (iii) to allow a guide edge GE thereof to scrape the mesh net 35 of the filtering unit 30 and remove dust thereon while raising and lowering.

Figure 8:
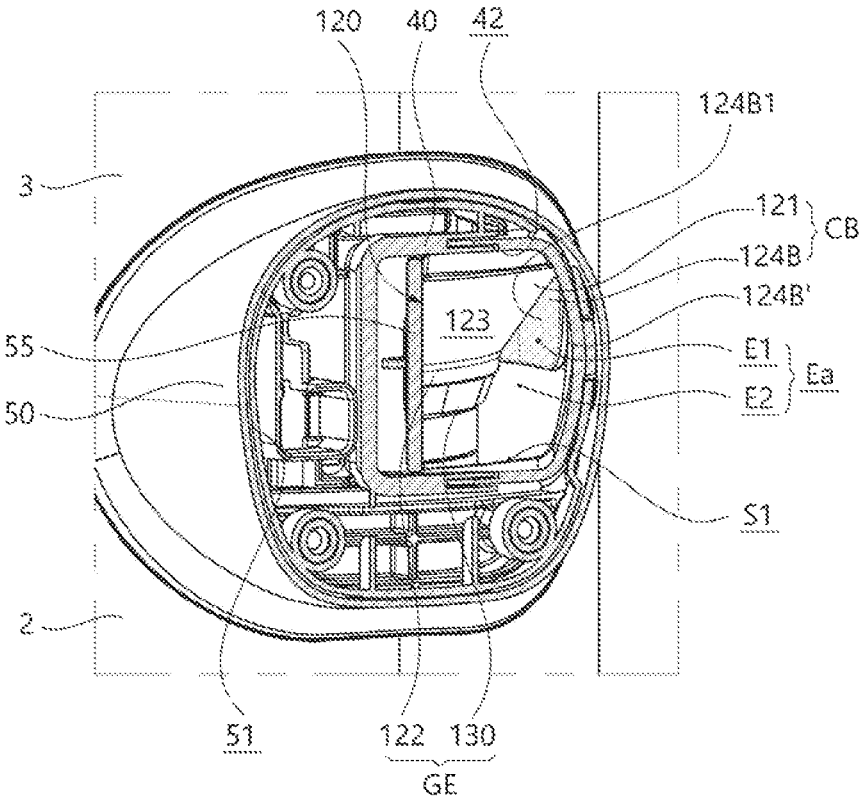
FIG. 8 is a sectional view taken along line II-II' of FIG. 1.

Referring to FIG. 8, the cleaning unit 110 can be seen to be connected to the introduction flow path 51 of the introduction housing 50. Reference numeral Ea refers to the entrance Ea of the guide flow path E, and air may flow spirally along the guide flow path E (see FIGS. 9 and 12). That is, the cleaning unit 110, the inner surface 20 of the housing 1, and the air guide 21 may constitute the first cyclone part such that the introduced air first flows in cyclone.

As described again below, referring to the entrance Ea of the guide flow path E, the guide flow path E may include a first guide flow path E1 located at a relatively upper portion and formed between a guide wall 121 and a guide fence 124B of the cleaning body 120, and a second guide flow path E2 located at a relatively lower portion and formed between the guide edge GE and the inner surface 20 of the housing 1.

Figure 9:
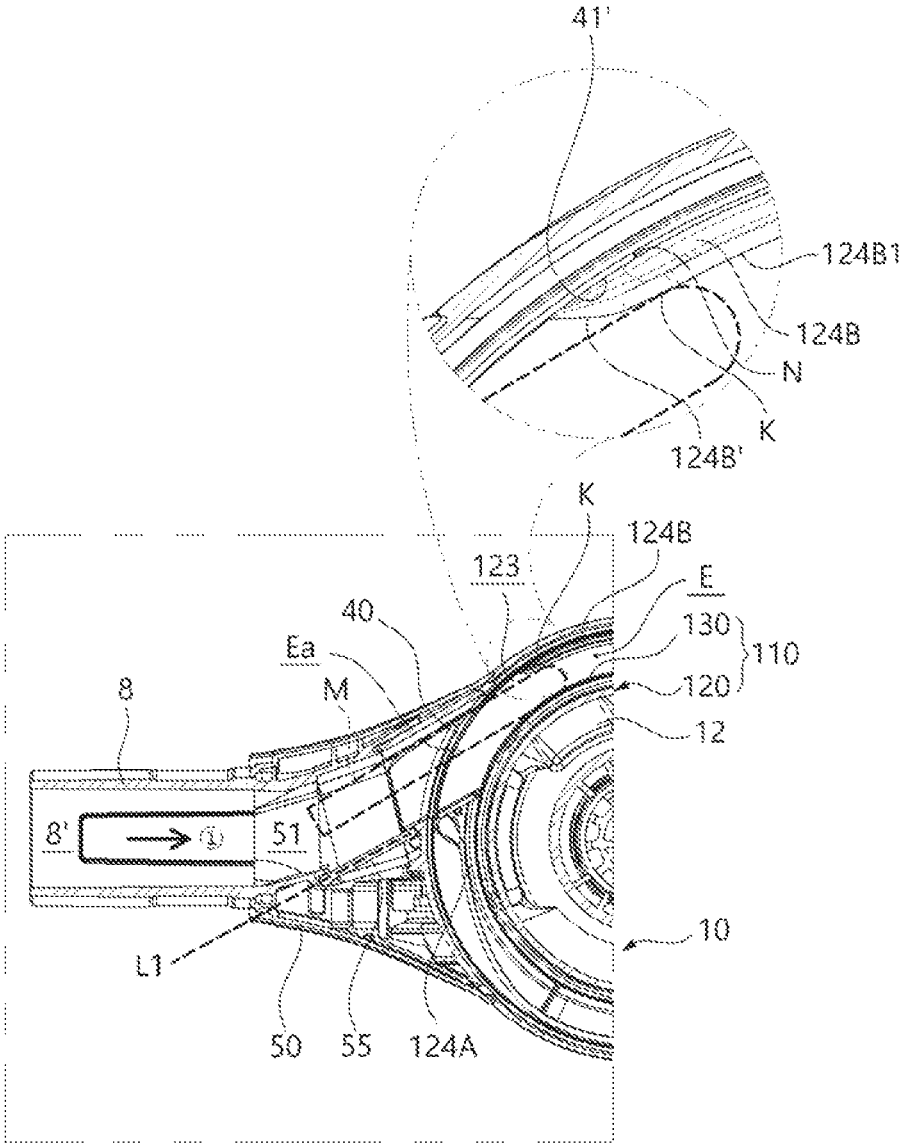
FIG. 9 is a cross-sectional view taken along line III-III' of FIG. 1.

FIG. 9 is a cross-sectional view of the cleaner viewed from the lower side thereof such that the introduction opening 8 and the introduction flow path 51 are clearly seen. External air may be introduced along the introduction space 8' located inside the introduction opening 8 and pass through the introduction flow path 51 of the introduction housing 50 (in the direction of arrow ①). The introduced air may be introduced to the inner space through an air introduction part 123. The air introduction part 123 may be provided at the entrance Ea of the guide flow path E of the cleaning unit 110, and may communicate with the air introduction path. The air introduction part 123 at which a portion of the guide fence 124B is omitted may function to communicate an air flow path with the introduction opening 8. Referring to FIG. 8, the air introduction part 123 may communicate with the introduction flow path 51 through the communication window 42 of the inner housing 40.

Referring back to FIG. 9, the air introduction part 123 may open the entrance Ea of the guide flow path E, and the introduced air and dust contained in the air may forcefully collide with the cleaning unit 110 at the entrance Ea of the guide flow path E. The dust may be introduced further inward along the guide flow path E after the collision.

In this case, when flat foreign matter P is introduced to the entrance Ea in an upright orientation (in an orientation of height larger in size than width), the foreign matter may efficiently pass through the entrance Ea of the guide flow path E which is narrow in width. However, when the foreign matter P is introduced to the entrance Ea with strong force in a vertical orientation (in an orientation of width larger in size than height), the foreign matter P may collide with the cleaning unit 110, and then be bounced toward the inner surface 20 of the housing 1 or the inner surface of the inner housing 40 by a reaction force to the collision and may be held therebetween. However, in the present disclosure this may be prevented by the guide edge GE, as described below.

In some embodiments, a guide blade 55 may be provided in the introduction housing 50. As illustrated in FIGS. 3, 8, and 9, the guide blade 55 may be a plate-shaped structure installed to block one side of an exit Eb of the introduction flow path 51. The guide blade 55 may set the path of the introduced air, and more precisely, induce the flow of air to the entrance Ea of the guide flow path E.

Figure 10:
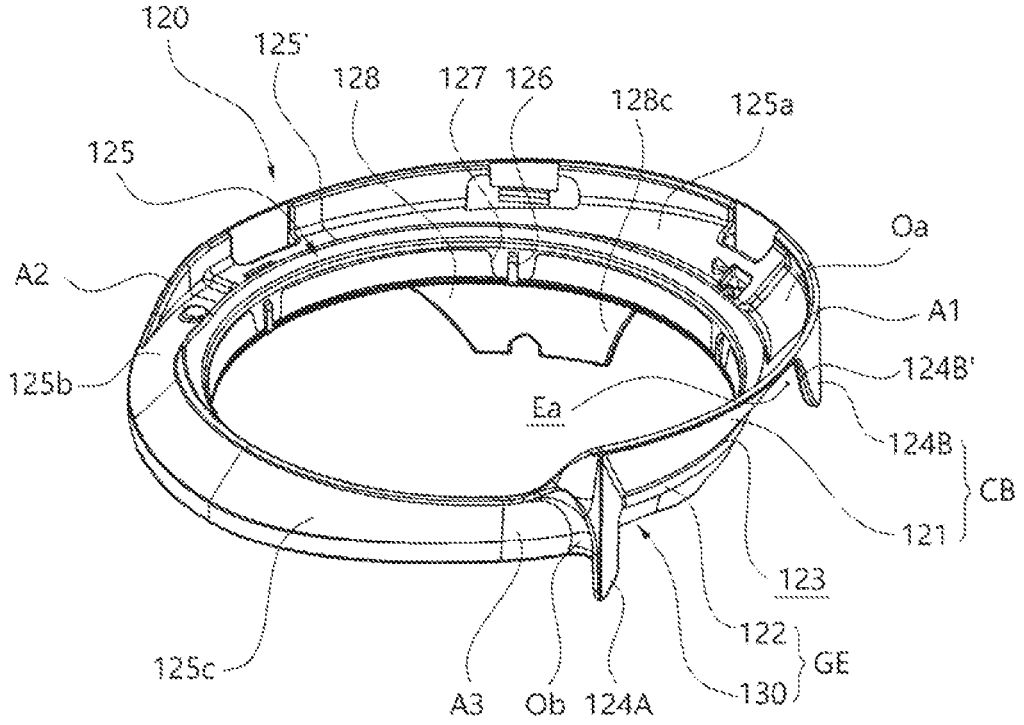
FIG. 10 is a perspective view illustrating an example configuration of the cleaning unit according to an embodiment of the present disclosure.

Referring to FIGS. 9 and 10, a duct blade 124A may be mounted to the cleaning body 120 of the cleaning unit 110. The duct blade 124A may be configured to block one side of the air introduction part 123. The duct blade 124A may allow the flow path of air to be formed in one direction relative to the duct blade 124A, that is, toward the entrance Ea of the guide flow path E. Furthermore, the duct blade 124A may have a shape extending longitudinally in the raising/lowering direction of the cleaning unit 110 and may increase the strength of the cleaning body 120.

As illustrated in FIG. 9, the duct blade 124A of the cleaning unit 110 and the guide blade 55 of the introduction housing 50 may be continuously arranged along an imaginary extension line L1. That is, the duct blade 124A and the guide blade 55 may form one continuous air flow path and may allow the introduced air to flow to the entrance Ea of the guide flow path E through the air introduction opening. In some embodiments, the imaginary extension line L1 is a straight line. Alternatively, the imaginary extension line L1 may be a curved line or a line bent at a predetermined angle.

Next, referring to FIGS. 10 to 12, the cleaning unit 110 will be described further in detail. Referring to FIG. 10, the cleaning unit 110 may mainly be composed of the cleaning body 120 and the guide edge GE. The cleaning body 120 may be a ring-shaped structure that forms the appearance of the cleaning unit 110, and the guide edge GE may extend from the lower end of the cleaning body 120. In some embodiments, the guide edge GE may be composed of the coupling end part 122 of the cleaning body 120 and the cleaning ring 130. Alternatively, only the cleaning ring 130 may constitute the guide edge GE. The guide edge GE may be a closed curve path having a ring shape. At least a portion of the guide edge GE may be located in the air introduction path extending from the introduction opening 8 and may guide the flow of the introduced air.

The cleaning body 120 may have an approximate ring shape surrounding the filtering unit 30, and may be connected to the manipulation unit 150. The cleaning body 120 may include the guide wall 121 and the guide fence 124B. The guide wall 121 and the guide fence 124B may be configured to be integrated with each other. The guide wall 121 may continuously extend in the circumferential direction of the cleaning body 120, and have the inclining surface on the surface thereof, and the guide edge GE may be provided on the lower portion thereof.

In addition, the guide fence 124B may extend parallel to the guide wall 121 and may be spaced apart from the guide wall 121 in a direction of the inner surface 20 of the housing 1. Accordingly, the guide flow path E which is the air flow path may be formed between the guide fence 124B and the guide wall 121. As illustrated in FIG. 8, the guide fence 124B may be formed at an end of the introduction opening 8 along the height direction (a vertical direction relative to FIG. 8) of the introduction opening 8, and the height of the guide flow path E may be formed to have at least the height of the guide fence 124B.

More precisely, since the guide fence 124B is omitted in the air introduction part 123, the guide flow path E may be formed between the outer surface of the guide wall 121 and the inner surface 20 of the housing 1. In a side further inward from the air introduction part 123, the guide flow path E may be formed between the outer surface of the guide wall 121 and the inner surface 124BI of the guide fence 124B (see FIGS. 8 and 9). That is, the guide wall 121 and the guide fence 124B may form a guide duct CB. The guide flow path E may be open in a direction of the dust collection space S1 located thereunder, and may induce the flowing air downward.

As for the guide fence 124B, the guide fence 124B may be provided along the outer edge of the cleaning body 120 constituting the cleaning unit 110, and may face the inner surface 20 of the housing 1, so that the guide fence 124B may form the guide flow path E at the inner side thereof by extending along the inner surface 20 of the housing 1. That is, the guide fence 124B may be in close contact with the inner surface 20 of the housing 1 or may be spaced apart by a predetermined distance therefrom, such that air may be prevented from flowing to a position between the guide fence 124B and the inner surface 20 of the housing 1.

As illustrated in FIGS. 8 to 10, a front surface part 124B' of the guide fence 124B may be formed at the front portion of the guide fence 124B. The front surface part 124B' may refer to a front end of the guide fence from which the guide fence 124B starts. That is, the front surface part 124B' may refer to the front of the guide fence 124B located at a position closest to the air introduction part 123. The front surface part 124B' may extend up to the front portion of the air introduction path and guide the initial flow of air.

More precisely, as illustrated in FIG. 9, the front surface part 124B' of the guide fence 124B may up to a position closer to the introduction opening 8 than the meeting position of the air introduction path (see M of FIG. 9) and the guide flow path E of the cleaning unit 110, more precisely, than the meeting position K of the air introduction path and the inner surface 124B1 of the guide fence 124B. As described above, the air introduction path may be regarded to include the introduction space 8' of the introduction opening 8 and the introduction flow path 51 of the introduction housing 50.

Referring to FIG. 9, the introduction flow path 51 connected to the introduction space 8' may extend in a slanting direction from the introduction space 8'. As described above, the introduction flow path 51 may be formed as the air introduction path of the direction of an approximate straight line since the duct blade 124A and the guide blade 55 may be continuously arranged along an imaginary extension line L1. Furthermore, such an air introduction path may be curved in a circumferential direction of the cleaning unit from a position at which the air introduction path meets the guide flow path E, and the flow of air passing through the guide flow path E may also be formed in the circumferential direction.

That is, at an initial stage, the introduced air may flow along the air introduction path (see M of FIG. 9) of the direction of an approximate straight line, and may flow in the direction of a curved line by passing through the entrance Ea of the guide flow path E to form an air cyclone flow.

In this case, as described above, the front surface part 124B' of the guide fence 124B may extend up to a position closer to the introduction opening 8 than the meeting position K of the air introduction path and the inner surface of the guide flow path E of the cleaning unit 110. The end portion K of an imaginary extension line M extending along the direction of the air introduction path may meet the inner surface of the guide flow path E instead of meeting the front surface part 124B' of the guide fence 124B.

In this case, before the introduced air is fully rotated and accelerated, the air may meet the front surface part 124B' of the guide fence 124B to prevent the introduced air from escaping to the gap N (see FIGS. 9 and 13) between the inner surface 20 of the housing 1 and the guide fence 124B. In some embodiments, the inner housing 40 may be mounted to the inner surface 20 of the housing 1. Accordingly, as illustrated in the enlarged view of FIG. 9, the front surface part 124B' of the guide fence 124B may prevent the introduced air from escaping to the gap N between the inner surface 41 of the inner housing 40 and the guide fence 124B. If the inner housing 40 is omitted, the front surface part 124B' of the guide fence 124B may block the air from escaping to the gap N between the inner surface 20 of the housing 1 and the guide fence 124B.

In other words, this means that the introduced air may not be introduced to another path, but may flow only through the guide flow path E. Accordingly, the dust separation efficiency of the cleaner may be improved. Furthermore, the introduced air may be prevented from being introduced to the gap N between the inner surface 41 of the inner housing 40 and the guide fence 124B such that dust contained in the air does not fall on the upper surface of the connection bracket 149 while the air flows over the outer surface of the guide fence 124B.

Figure 13:
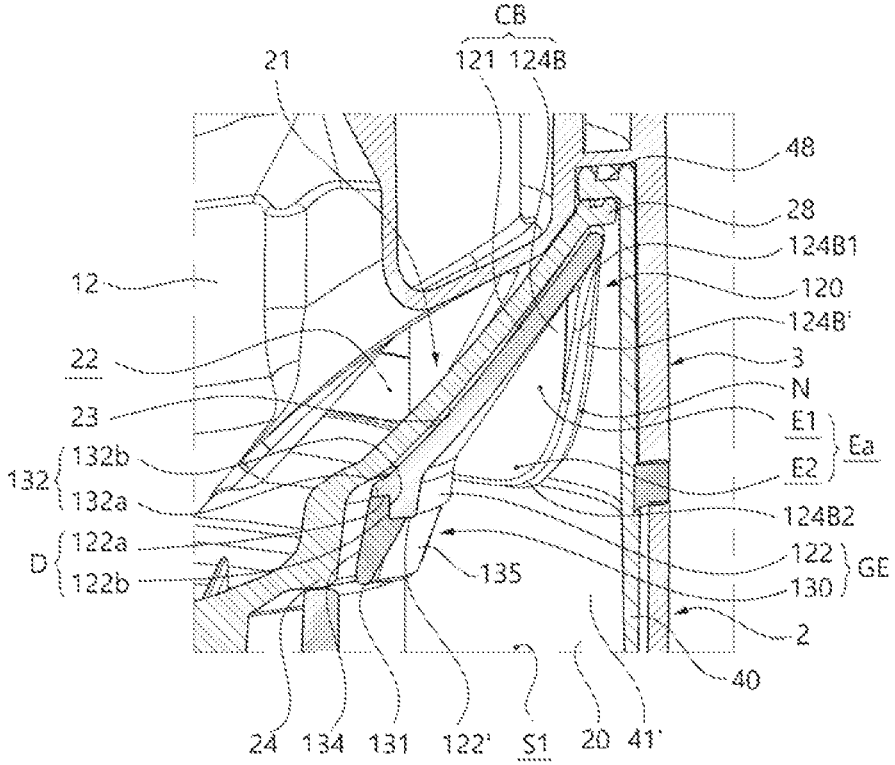
FIG. 13 is a sectional view illustrating an example configuration of an air introduction part according to an embodiment of the present disclosure.

The degree of protrusion of the front surface part 124B' of the guide fence 124B toward the air introduction part 123 may be formed to be different along the raising/lowering direction of the cleaning unit 110. Referring to FIG. 13, in the front surface part 124B' of the guide fence 124B, the upper portion 124B1 may protrude more toward the air introduction part 123 than the lower portion 124B2 relative to the raising/lowering direction of the cleaning unit 110 (a vertical direction relative to FIG. 13). Conversely, in the front surface part 124B' of the guide fence 124B, the upper portion 124B2 may protrude more toward the air introduction part 123 than the lower portion 124B1 relative to the raising/lowering direction of the cleaning unit 110 (a vertical direction relative to FIG. 13).

When the degree of protrusion of the front surface part 124B' of the guide fence 124B toward the air introduction part 123 is formed to be different along the raising/lowering direction of the cleaning unit 110, an area in which the introduced air first collides with the front surface part 124B' of the guide fence 124B may be decreased. For example, if the front surface part 124B' is a flat surface in which the degree of protrusion of the front surface part 124B' of the guide fence 124B toward the air introduction part 123 is formed to be the same along the raising/lowering direction of the cleaning unit 110, the introduced air may collide with the entirety of the front surface part 124B', and thus dust contained in the air may have high probability of being trapped therein.

However, according to some embodiments of the present disclosure, dust may naturally flow to one side along the front surface part 124B'. In some embodiments, the upper portion 124B1 of the front surface part 124B' may protrude further toward the air introduction part 123 than the lower portion 124B2 relative to the raising/lowering direction of the cleaning unit 110 (a vertical direction relative to FIG. 13). Accordingly, the colliding area of the introduced air with the guide fence 124B may be reduced, so dust contained in the air may be naturally induced from the upper portion 124B1 toward the lower portion 124B2, and may be prevented from being trapped in the front portion of the front surface part 124B'. To make such a flow natural, the front surface part 124B' of the guide fence 124B may be formed as a continuous curved surface or inclining surface along the raising/lowering direction of the cleaning unit 110.

In addition, to guide dust more efficiently, the front surface part 124B' of the guide fence 124B may be formed to gradually become thinner toward the air introduction part 123. In this case, the area in which the introduced air collides with the guide fence 124B may be further reduced. For example, the opposite edges of the front surface part 124B' may be slanted such that the front surface part 124B' may gradually become thinner. However, as illustrated the enlarged view of FIG. 9, of the opposite edges of the front surface part 124B', a portion of the front surface part 124B' directed toward the inner surface 41 of the inner housing 40 may be formed as a flat surface, and a portion of the front surface part 124B directed toward the guide flow path E may be formed as a curved surface or an inclining surface. In this case, air may be guided more naturally toward the guide flow path E.

As illustrated in FIG. 13, the coupling end part 122 may be provided on the lower end of the guide wall 121. The coupling end part 122 may be a portion extending downward from the lower end of the guide wall 121, and the cleaning ring 130 may be coupled thereto. The surface of the coupling end part 122 and the surface of the cleaning ring 130 may constitute the guide edge GE, and may constitute a guide inclination surface 135. That is, the surface of the coupling end part 122 may extend to gradually incline downward toward the dust collection space S1, so an inclining surface may be formed on the surface thereof. Such an inclining surface may induce some reaction forces caused by collision of large foreign matter with the inclining surface to be directed downward. The configuration of the coupling end part 122 is described in further detail below.

The guide wall 121 may be provided in an inclining direction to the raising/lowering direction of the cleaning unit 110, and may guide the flow of the air introduced through the introduction opening 8 when the cleaning unit 110 is located at the initial position. Referring to FIG. 13, the outer surface of the guide wall 121 can be seen to extend slantingly. Since the outer surface of the guide wall 121 may extend to incline downward, the guide wall 121 may efficiently move the air downward.

Preferably, the guide wall 121 of the cleaning body 120 may extend to incline such that a gap between the guide wall 121 and the inner surface 20 of the housing 1 increases downward toward the guide edge GE, and may induce the flow of air downward, and the width of the guide wall 121 may be increased to improve the air flow.

Figure 11:
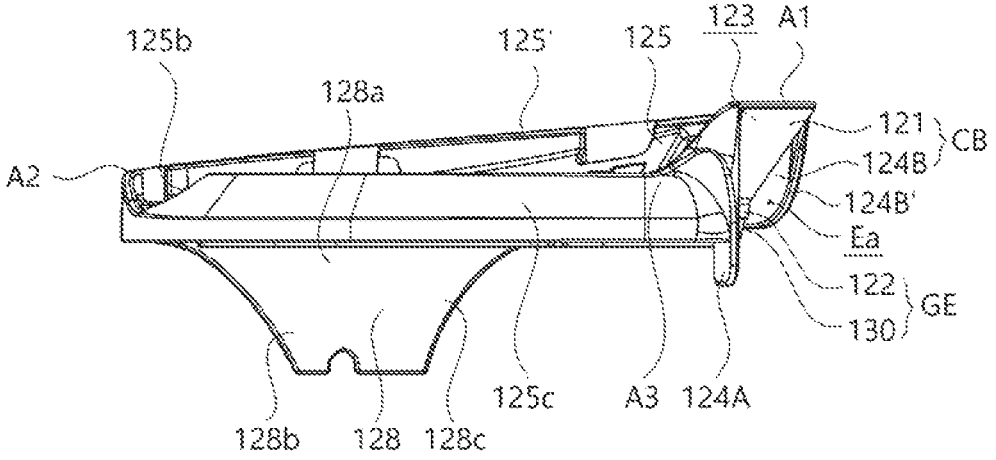
FIG. 11 is a front view of the configuration of the cleaning unit illustrated in FIG. 10.

In addition, referring to FIGS. 10 and 11, the guide wall 121 and the guide fence 124B may be the highest at the entrance Ea of the guide flow path E. The heights thereof may gradually decrease along the circumferential direction thereof, and may be the lowest at a position adjacent to the duct blade 124A corresponding to the exit Eb of the guide flow path E. Accordingly, the sectional area of the guide flow path E may also gradually decrease along the air flow direction of the guide flow path E. At the same time, the guide flow path E may form an air flow path that gradually lowers toward the exit Eb. Such a structure may function to form an air cyclone flow due to the first cyclone part.

The connecting plate 128 may be provided in the cleaning body 120. As illustrated in FIGS. 10 and 11, the connecting plate 128 may have the structure of a plate shape extending in the raising/lowering direction of the cleaning unit 110, and may raise and lower in the state of being in close contact with the inner surface 20 of the housing 1. The connecting plate 128 may be a part connecting the manipulation unit 150 with the cleaning body 120.

The cleaning body 120 may be configured to extend in the form of a cantilever from the manipulation unit 150 (see FIGS. 5A and 5B). Accordingly, a large load may be applied to the connection part located between the manipulation unit 150 and the cleaning body 120. Accordingly, the connection part may be required to be reinforced. To this end, the connecting plate 128 may extend along the raising/lowering direction of the cleaning unit 110 and may provide a wide connection part. In some embodiments, the reinforcement plate 140 may be correspondingly coupled to the connecting plate 128, so the strength of the connection part may be further increased, as described below.

Figure 17:
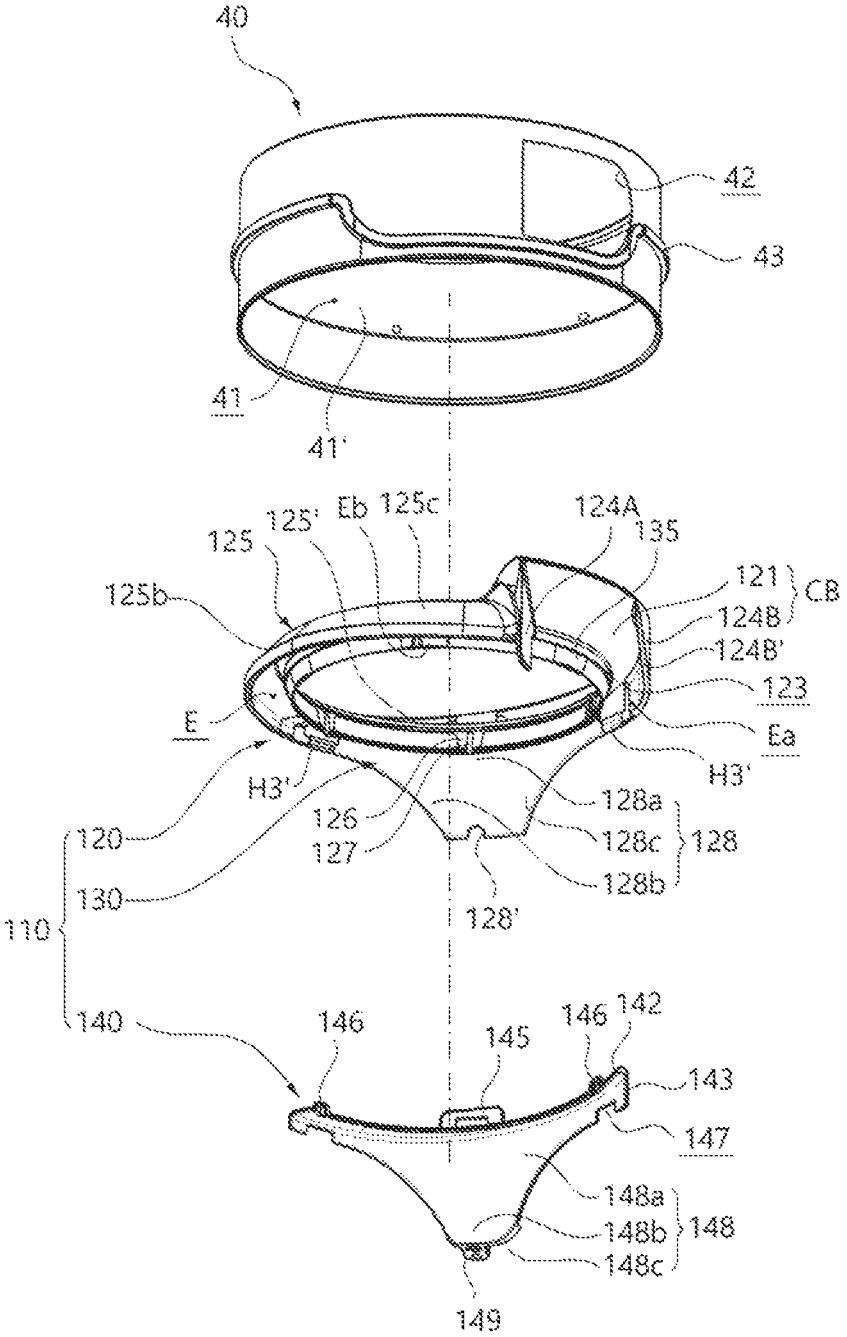
FIG. 17 is an exploded perspective view of each of the components of FIG. 14 viewed at a different angle from FIG. 16.

The connecting plate 128 may extend from the cleaning body 120 while gradually becoming narrower in width in left and right directions toward a position far from the cleaning body 120. Due to the widths in the left and right directions gradually becoming narrower, the volume of the connecting plate 128 occupying the dust collection space S1 therein may be decreased and air flow may not be prevented. Furthermore, a connection bracket 149 connected to the manipulation unit 150 may be provided in an end portion of the connecting plate 128 that decreases in width, such the connecting plate 128 may be connected directly to the manipulation unit 150. However, In some embodiments, the connecting plate 128 may be connected to the manipulation unit 150 by the reinforcement plate 140, as described below. In FIG. 17, reference numeral 128' may refer to an assembly groove which allows the connection bracket 149 to protrude toward the rear of the connecting plate 128.

Figure 12A:
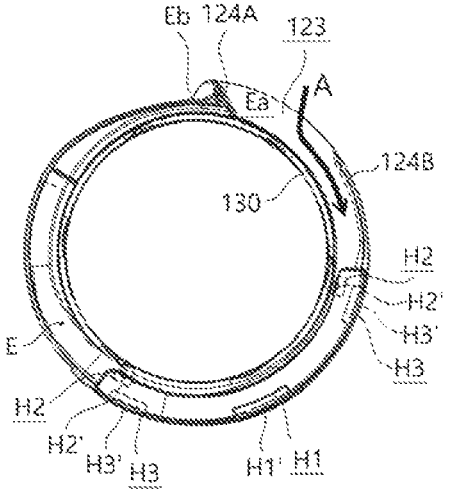
FIGS. 12A and 12B are a top plan view and a bottom view, respectively, illustrating the configuration of the cleaning unit illustrated in FIG. 10.

Referring to FIG. 12A, the guide flow path E formed between the guide wall 121 and the guide fence 124B may be continuously formed along the circumferential direction thereof from the entrance Ea of the guide flow path E to the exit Eb thereof, and arrow A may refer to a path through which air is introduced and flows. The guide flow path E may extend to have a predetermined width, and the width thereof may become narrow at the exit Eb (i.e. at the position of the duct blade 124A) so the air flow rate may increase. In some embodiments, the guide wall 121 may be provided along the entire path of the guide flow path E, but the guide fence 124B may be omitted at the air introduction part 123 for the introduction of air through the introduction opening 8.

Meanwhile, an upper cleaning part 125 may be formed on the upper surface of the cleaning body 120 corresponding to the opposite side of the guide flow path E. The upper cleaning part 125 may be provided as a continuous path along the circumferential direction of the cleaning body 120. When air flows toward the upper cleaning part 125, dust accumulated on the upper surface of the cleaning body 120 may be removed. Most of the introduced air may flow along the guide flow path E, but some of the air may be introduced to the upper side of the cleaning body 120 such that dust may accumulate on the upper surface of the cleaning body 120. Even when air is introduced while the cleaning unit 110 is lowered, dust may accumulate on the upper surface of the cleaning body 120. The dust may be removed through the structure of the upper cleaning part 125.

Referring to FIG. 10, the entrance Oa of the upper cleaning part 125, starting at a position adjacent to the air introduction part 123, may be formed at a location higher than the exit Ob of the upper cleaning part 125. That is, the height of the upper cleaning part 125 may gradually decrease along a circumferential direction from the entrance Oa to the exit Ob. A first section 125*a* constituting the upper cleaning part 125 may be the highest portion, and a second section 125*b* extending from the first section 125*a* may be lower than the first section 125*a*. Furthermore, a third section 125*c* may be a portion closest to the duct blade 124A which is the exit Ob and may be lowest.

In this case, the height of the upper cleaning part 125 may decrease from the first section 125*a* toward the third section 125*c*, but the height of a middle portion therebetween may slightly increase. For example, to reinforce the strength of the cleaning body 120, a section in which the height of the upper cleaning part 125 increases may be provided. In some embodiments, the height of a portion of the second section 125*b* may slightly increase and then decrease.

An upper fence 125' may protrude from the edge of the cleaning body 120. The upper fence 125' may form the flow path of air flowing in the upper cleaning part 125. The upper fence 125' may protrude upward from the edge of the upper surface of the cleaning body 120, and thus may constitute a portion of the upper cleaning part 125, and face the inner space S1 of the housing 1. The upper fence 125' may be provided from the first section 125*a* to the second section 125*b*, but may not be omitted in the third section 125*c*. This is because the third section 125*c* may be a section in which the air flowing along the circumferential direction of the cleaning body 120 is discharged.

Figure 12B:
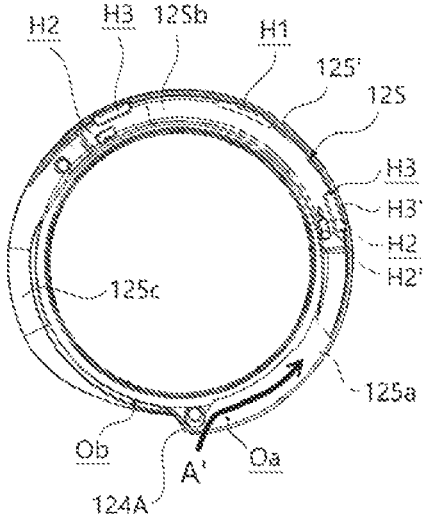

Referring to FIG. 12B, the widths of the first section 125*a* and the second section 125*b* may be similar to each other, but the width of the third section 125*c* may become relatively narrower. Accordingly, the exit Ob of the upper cleaning part 125 may be spaced apart from the inner surface 20 of the housing 1, and space may be defined therebetween. The introduced air may flow downward toward the dust collection space S1 through the space. In FIG. 12B, arrow A' indicates a direction in which the air introduced to the upper portion of the cleaning body 120 flows along the upper cleaning part 125.

Referring to FIG. 13, the configuration of the cleaning unit 110 at a portion adjacent to the air introduction part 123 is illustrated in a cross-section view. FIG. 13 illustrates a state in which the cleaning unit 110 is located at the initial position. The cleaning unit 110 may be located by being fitted over the air guide surface 23 of the air guide 21. The cleaning unit 110 may be located at a side further outward than the air guide surface 23, and thus the introduced air may be guided by the cleaning unit 110.

The guide flow path E may be the path through which air flows. Referring to the entrance Ea of the guide flow path E, the guide flow path E may include the first guide flow path E1 located at a relatively upper portion and formed between the guide wall 121 and the guide fence 124B of the cleaning body 120, and the second guide flow path E2 located at a relatively lower portion and formed between the guide edge GE and the inner surface 20 of the housing 1. The first guide flow path E1 and the second guide flow path E2 may be connected to the air introduction part 123, and the air introduction part 123 may be regarded as a portion of the guide flow path E. The first guide flow path E1 and the second guide flow path E2 may be formed in the same way at the entrance Ea of the guide flow path E and along the guide flow path E.

The guide wall 121 may be provided in the cleaning body 120 constituting the cleaning unit 110. The gap between the guide wall 121 and the inner surface 20 of the housing 1 facing the guide wall 121 at the same height may gradually increase in the direction toward the bottom surface of the dust collection space S1. Accordingly, the inclining surface may be formed on the outer surface of the guide wall 121 and may induce air downward.

The coupling end part 122 may be located at the lower end of the guide wall 121. The coupling end part 122 may constitute the guide edge GE together with the cleaning ring 130, as described below. The guide edge GE may extend toward the bottom of the dust collection space S1, and the surface of the guide edge GE facing the inner surface 20 of the housing 1 may extend to be inclined to gradually increase the gap between the surface of the guide edge GE and the inner surface 20 of the housing 1 at the same height in a direction toward the end portion of the guide edge that is directed toward the bottom of the dust collection space S1.

In other words, the guide edge GE may extend such that the diameter of the cleaning unit 110 gradually becomes smaller toward the bottom of the dust collection space S1. Accordingly, the guide inclination surface 135 may be formed on the surface of the guide edge GE, and the width of the guide flow path E may increase toward the lower portion of the guide edge GE. Furthermore, the cleaning ring 130 may slant such that it is close to the surface of the second cyclone part 30 in the direction thereof toward the end portion of the cleaning ring toward the bottom of the dust collection space S1, so that the guide inclination surface 135 is formed on the surface of the cleaning ring 130 facing the inner surface 20 of the housing 1.

In some embodiments, the cleaning ring 130 may be coupled to the lower end of the guide wall 121 of the cleaning body 120. The cleaning ring 130 may be coupled to and may raise and lower with the coupling end part 122 located at the lower end of the guide wall 121. The cleaning ring 120 may function to compress dust and scrape off dust on the mesh net 35 while raising and lowering. The cleaning ring 130 may be made of an elastic material, for example, rubber or silicone, and may be transformed to some extent in the process of the compression such that the cleaning unit 110 may more efficiently raise and lower. The cleaning ring 130 being made of an elastic material may be advantageous in scraping off the dust on the outer surface of the mesh net 35.

The cleaning ring 130 may be approximately ring-shaped. In some embodiments, the cleaning ring 130 may be coupled to the coupling end part 122 of the guide wall 121 through double injection. The front surface 135 of the cleaning ring 130 coupled to the coupling end part 122 may face the inner surface 20 of the housing 1, and the rear surface 134 of the cleaning ring 130 may face the surface of the filtering unit 30 as the cleaning unit 110 is lowered. The front surface 135 of the cleaning ring 130 may be the guide inclination surface 135, so the same reference numeral is assigned thereto.

As the coupling portion of the cleaning ring 130 and the guide wall 121 to each other is seen in FIG. 13, in the upper surface 132 of the cleaning ring 130, an upper coupling portion 132*a* and a first surface coupling portion 132*b* may be connected to each other so as to be orthogonal to each other. A lower coupling portion 122*a* and a second surface coupling portion 122*b* may be formed on the lower surface of the coupling end part 122 engaging with the upper coupling portion 132*a* and the first surface coupling portion 132*b*. The coupling portion of the cleaning ring 130 and the guide wall 121 to each other may approximately form an L-shaped section, thereby increasing a coupling area between the cleaning ring 130 and the guide wall 121.

Accordingly, the coupling force between the upper surface 132 of the cleaning ring 130 and the lower surface of the guide wall 121 engaged with each other may be weaker compared to the coupling force between the cleaning ring 130 and the guide wall 121 when the front surface 135 and the rear surface 134 of the cleaning ring 130 are engaged with the guide wall 121. However, In some embodiments, a support rib 126 may be provided in the guide wall 121 to compensate for this.

Figure 14:
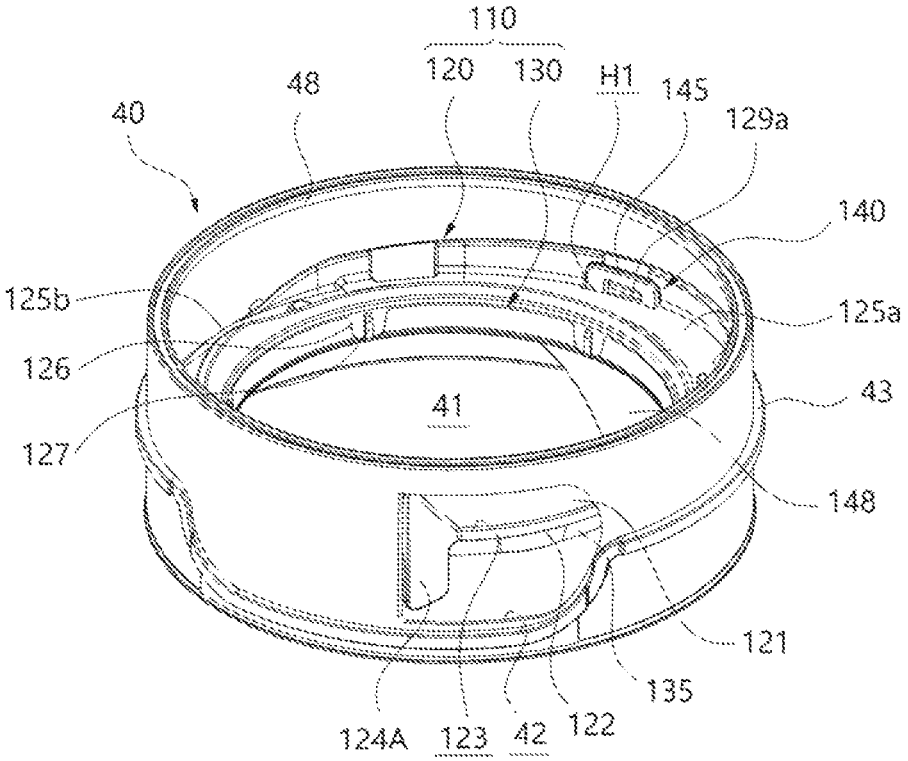
FIG. 14 is a perspective view illustrating an example configuration of the cleaning unit and an inner according to an embodiment of the present disclosure.

Referring to FIGS. 10 and 14, the support rib 126 may be provided in the cleaning unit 110. The support rib 126 may protrude from the lower portion of the cleaning body 120. More precisely, the support rib 126 may protrude downward from the coupling end part 122 of the guide wall 121. The support rib 126 may protrude toward the bottom of the dust collection space S1, and may support the rear surface 134 of the cleaning ring 130, which may be the opposite surface of the guide inclination surface 135 of the cleaning ring 130. That is, the support rib 126 may support a portion corresponding to the lower surface of the cleaning ring 130 at the rear thereof.

Multiple support ribs 126 may be provided on the circumference of the cleaning body 120, and at least a portion of each of the support ribs 126 may protrude up to or more than the lower end of the cleaning ring 130.

In some embodiments, the cleaning ring 130 may be coupled to the cleaning body 120 through double injection. In the process of the double injection, the cleaning ring 130 may be deformed due to high temperature, but the support rib 126 may prevent the deformation. Furthermore, even in the process of the raising and lowering of the cleaning unit 110, the support rib 126 may prevent the cleaning ring 130 from curling. The cleaning ring 130 may be attached to the cleaning body 120 by an adhesive or other attachment means, or may be assembled therewith in various ways such as a forcible fitting manner or a protrusion coupling manner.

In addition, a gap maintenance rib 127 may protrude from the support rib 126. The gap maintenance rib 127 may extend in the raising/lowering direction of the cleaning unit 110, and may prevent the cleaning unit 110 from being off center in the process of the raising and lowering of the cleaning unit 110. Without the gap maintenance rib 127, when the cleaning unit 110 is off center, the cleaning ring 130 (which may be made of a flexible material) may be curled up or turned over while rubbing against the mesh net 35. The gap maintenance rib 127 may solve such a problem.

Referring to FIG. 13, a step 122' may be provided in the coupling end part 122. The step 122' may be formed as a protrusion of coupling end part 122 from the cleaning ring 130 in the direction of the inner surface 20 of the housing 1. Due to this, the thickness of the coupling end part 122 may be described to be larger than the thickness of the cleaning ring 130. Due to such a step 122', the lower surface of the coupling end part 122 to which the cleaning ring 130 may be double injected and coupled may be wider so as to stabilize the coupling of the cleaning ring 130 and the coupling end part 122 to each other and to facilitate the double injection operation of the cleaning ring 130.

Figure 15:
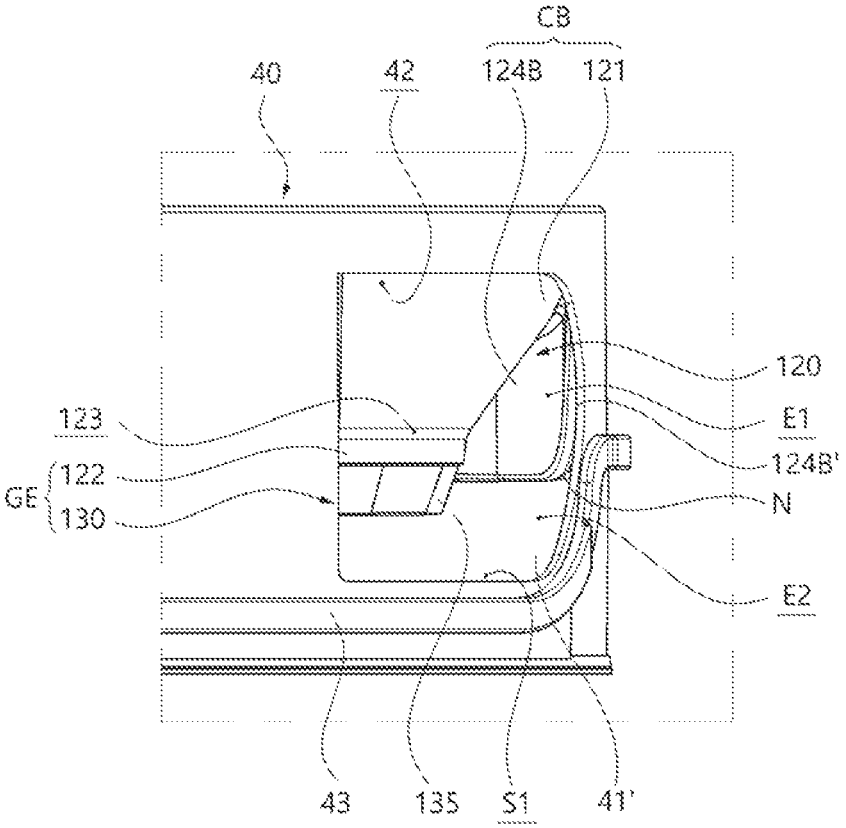
FIG. 15 is a front view of the air introduction part of the cleaning unit of FIG. 14 viewed through a communication window of the inner housing.

Referring to FIG. 14, the cleaning unit 110 may be assembled with the inner housing 40. A portion of the cleaning unit 110 may be connected to the introduction opening 8 through the communication window 42 formed in the inner housing 40. The air introduction part 123 of the cleaning unit 110 may be located at the inner side of the communication window 42, and the duct blade 124A may be in close contact with a side of the communication window 42. Accordingly, air introduced through the introduction opening 8 may be naturally guided to the air introduction part 123. Referring to FIG. 15, the upper portion of the guide wall 121 may block the upper portion of the cleaning body 120 relative thereto, so the introduced air may naturally flow downward.

That is, the air introduced through the air introduction part 123 may flow along the guide flow path E located between the guide wall 121 and the guide fence 124B constituting the cleaning body 120. Of course, some of the introduced air may be introduced to the upper cleaning part 125. However, the air introduced to the upper surface of the cleaning body 120 may flow along the upper cleaning part 125 due to the structure of the upper cleaning part 125 described above, and then may be discharged in the direction of the dust collection space S1.

FIG. 16 shows the cleaning unit 110 and the inner housing 40 separated from each other and the reinforcement plate 140 separated from the cleaning body 120. The reinforcement plate 140 may be correspondingly coupled to the connecting plate 128 of the cleaning body 120 and may function to reinforce the connecting plate 128. The cleaning body 120, the cleaning ring 130, and the connecting plate 128 may form cleaning unit 110.

As for the structure of the assembly body 141, the first assembly body 142 and the second assembly body 143 may be provided in the assembly body 141. The first assembly body 142 and the second assembly body 143 may be bent relative to each other. In some embodiments, the second assembly body 143 may protrude from the first assembly body 142 may be bent therefrom. The first assembly body 142 and the second assembly body 143 may extend in an overall arc shape and may be coupled to a section of the cleaning body 120.

More precisely, the assembly body 141 may be inserted to and coupled to the guide flow path E formed between the guide wall 121 and the guide fence 124B of the cleaning body 120 to correspond to the guide flow path E. As illustrated in FIG. 24, the reinforcement plate 140 may be configured to constitute a portion of the guide flow path E. Accordingly, the reinforcement plate 140 may not prevent the flow of air.

As illustrated in FIGS. 16 and 17, the assembly body 141 may have components therein to be assembled with the cleaning body 120, and may include a first assembly part 145, a second assembly part 146, and the third assembly part 147. These assembly parts may be held in corresponding assembly parts provided in the cleaning body 120 in the process in which the assembly parts are assembled with the cleaning body 120 so that the reinforcement plate 140 is fixed to the cleaning body 120. The detailed structure of the assembling is described further below.

The connection bracket 149 may be provided at a side of the reinforcement body 148 of the reinforcement plate 140. The connection bracket 149 may protrude from the lower portion of the reinforcement body 148 in the direction of the inner surface 20 of the housing 1. The connection bracket 149 may be connected to the lower end of the movable rail 175 of the manipulation unit 150 so that the movable rail 175 and the reinforcement plate 140 raise and lower together. Although not shown, the connection bracket 149 may be raised and lowered while being inserted to a raising/lowering channel provided in the inner surface 20 of the housing 1, and may be assembled with the movable rail 175 by a separate fastener such as a bolt.

Such a reinforcement plate 140 may be made of various materials. For example, the reinforcement plate 140 may be made of synthetic resin or metal. In some embodiments, the reinforcement plate 140 may be made of aluminum, and the cleaning body 120 may be made of synthetic resin.

Figure 18:
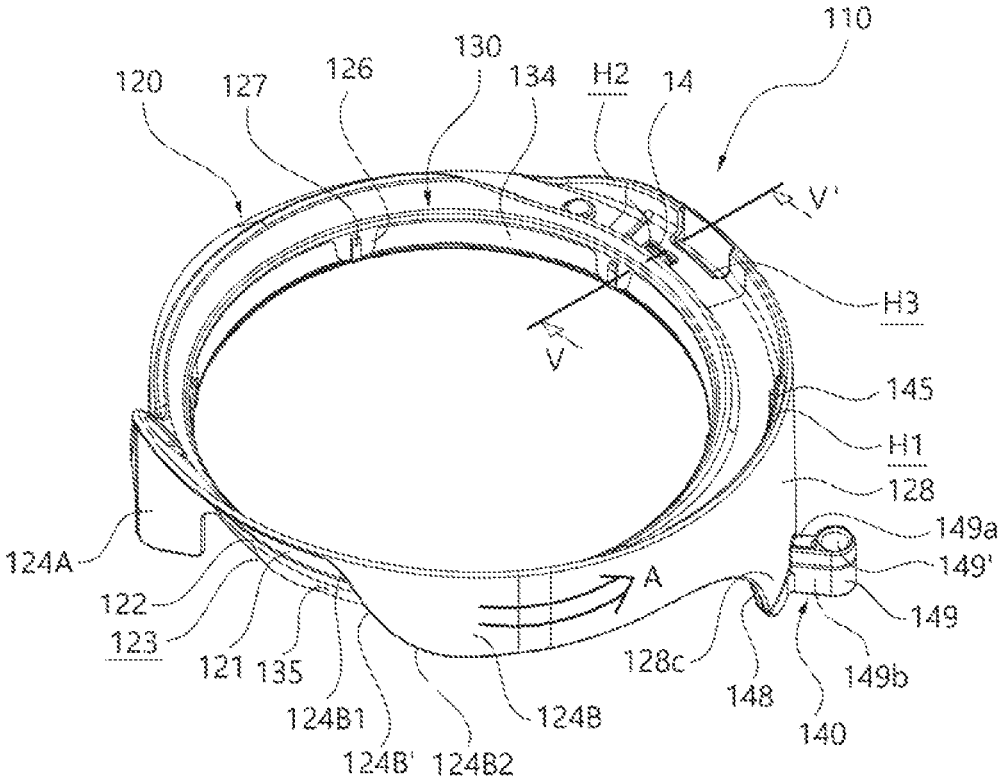
FIG. 18 is a perspective view illustrating an example configuration of the cleaning unit according to an embodiment of the present disclosure.
Figure 19:
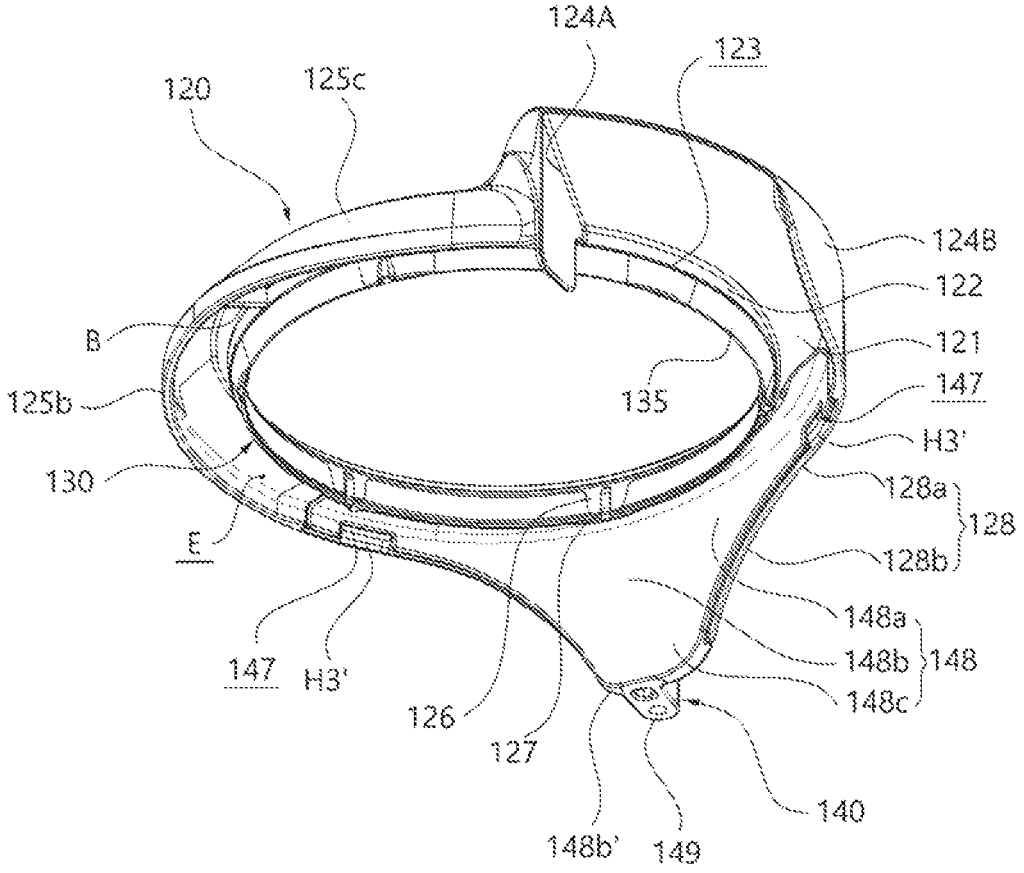
FIG. 19 is a perspective view illustrating an example configuration of the cleaning unit according to an embodiment of the present disclosure viewed at a different angle from FIG. 18.

Referring to FIGS. 18 and 19, blocking walls 128*c* and 148*c* may be provided in the cleaning unit 110. The blocking walls may include an outer blocking wall 128*c* and an inner blocking wall 148*c*. The outer blocking wall 128*c* may be provided in the connecting plate 128. The outer blocking wall 128*c* may be formed in the connecting plate 128 in the opposite direction of the direction A of the air flow formed along the guide flow path. The surface of the outer blocking wall 128*c* facing the inner surface 20 of the housing 1 may be formed as a curved surface, which may be continuous to the surface of the connecting plate 128. Accordingly, the outer surface of the outer blocking wall 128*c* may face the inner surface 20 of the housing 1.

The outer blocking wall 128*c* may be regarded to be a portion in which the area of the connecting plate 128 is further increased. That is, the outer blocking wall 128*c* may be regarded to be a portion in which a portion of the connecting plate 128 is further extended.

Figure 20:
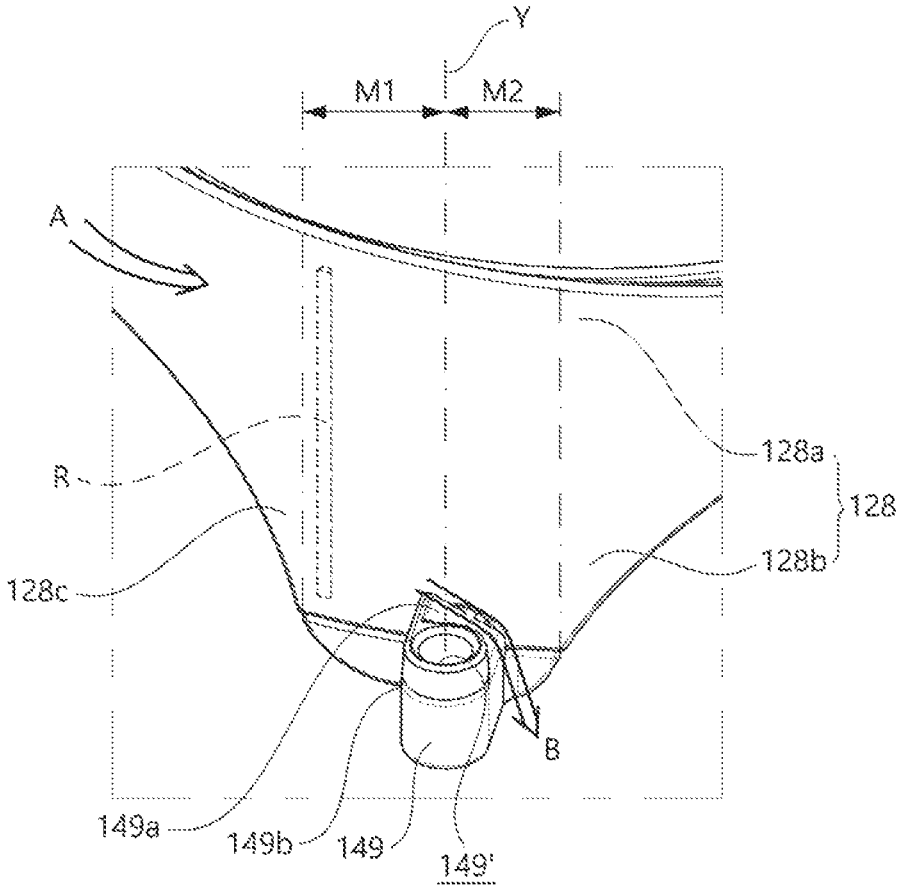
FIG. 20 is a perspective view illustrating an example connection bracket of the cleaning unit viewed from the rear of the cleaning unit according to an embodiment of the present disclosure.

In some embodiments, as illustrated in FIG. 20, when viewed relative to the reference line Y passing through the center of the connecting plate 128, a left portion M1 at which the outer blocking wall 128*c* is located may be larger in an area than a right portion M2. Accordingly, the extension of the connecting plate 128 in the opposite direction of the direction A of the air flow may make it more difficult for dust moving along the air flow to be introduced to the connection bracket 149.

With the outer surface of the outer blocking wall 128*c* facing the inner surface 20 of the housing 1, due to the presence of the outer blocking wall 128*c*, a section in which dust contained in air is introduced to space between the inner surface 20 of the housing 1 and the outer blocking wall 128*c* and reaches the connection bracket 149 may become longer. As a result, the dust may be prevented from being accumulated on the upper portion of the connection bracket 149.

Since the reinforcement plate 140 may be coupled to the connecting plate 128, an inner blocking wall 148*c* having the same shape as the shape of the outer blocking wall 128*c* may be formed on the reinforcement plate 140. As illustrated in FIGS. 6 and 19, the inner blocking wall 148*c* may have the same shape as the shape of the outer blocking wall 128*c*. Accordingly, the end portions of the inner blocking wall 148*c* and the outer blocking wall 128*c* may be thicker. When the reinforcement plate 140 is omitted, the inner blocking wall 148*c* may also be omitted. In some embodiments, the outer blocking wall 128*c* may be configured as a shape different from the shape of the inner blocking wall 148*c*.

As shown in FIG. 20, the filter rib R may be provided on the surface of the connecting plate 128. Although the filter rib R described above is provided in the inner surface 20 of the housing 1, in some embodiments, the filter rib R may be provided in the connecting plate 128. Alternatively, the filter rib R may be provided on each of the surface of the connecting plate 128 and the inner surface 20 of the housing 1. The filter rib R provided on the surface of the connecting plate 128 may function to reduce the gap between the inner surface 20 of the housing 1 and the outer surface of the connecting plate 128.

The reinforcement plate 140 may be coupled to the cleaning body 120. As shown in FIG. 19, the reinforcement plate 140 may be coupled to the front of the connecting plate 128 connected to the lower portion of the cleaning body 120. The force of raising and lowering the cleaning unit 110 may be focused on the connection bracket 149 connected to the manipulation unit 150. The portion of cleaning unit 110 protruding toward the introduction opening 8 may be relatively long compared to the connection bracket 149. Accordingly, a large load may be inevitably focused on the connection bracket 149 and the connection part (i.e. connecting plate 128) may be easily warped. When the connecting plate 128 is warped, the cleaning unit 110 may be off center as a whole, and the efficient raising thereof may be prevented or restricted.

In some embodiments, the reinforcement plate 140 may be coupled to the cleaning body 120 to increase the strength of the connection part. Accordingly, the reinforcement plate 140 may prevent the connection part from being warped or bent by an external force. As described above, the shape of the reinforcement body 148 of the reinforcement plate 140 may correspond to the shape of the connecting plate 128, so a contact area therebetween may be relatively large. As illustrated in FIG. 24, in some embodiments, the shape of the connecting plate 128 may be the same or approximately the same as the shape of the reinforcement body 148 of the reinforcement plate 140. Alternatively, the reinforcement body 148 may be coupled to only a portion of the connecting plate 128.

FIGS. 20 and 21 illustrate the structure of the connection bracket 149. In FIG. 21, the connection bracket 149 is illustrated to be fitted over the raising/lowering channel GH. The connection bracket 149 may protrude from the reinforcement plate 140 in the direction of the raising/lowering channel GH and may include a fastening hole 149' at the center thereof such that a fastener may be inserted to the fastening hole. When the fastener, such as a bolt or screw, is inserted to the fastening hole 149', the connection bracket 149 may be assembled with the movable rail 175.

In this case, a discharge inclining surface 149*a* having a height that gradually decreases toward the bottom of the dust collection space S1 may be formed on the upper surface of the connection bracket 149 relative to the raising/lowering direction of the cleaning unit 110. The discharge inclining surface 149*a* may be formed to have a height that gradually decreases along the direction of the air flow formed by the guide flow path E (e.g. along the direction of arrow A). Accordingly, although dust is accumulated on the discharge inclining surface 149*a*, the dust may fall toward the side of the bottom of the dust collection space S1 by gravity (e.g., along the direction of arrow B).

In addition, a flat surface portion 149*b* may be formed on a surface of the connection bracket 149 parallel to the raising/lowering direction of connection bracket 149 at a side facing the direction of the air flow formed by the guide flow path (i.e. direction of arrow A). As illustrated in FIG. 20, the flat surface portion 149*b* may be a flat surface, and the discharge inclining surface 149*a* may start from the upper end of the flat surface portion 149*b*. More precisely, the highest position of the discharge inclining surface 149*a* may start from the upper end of the flat surface portion 149*b*.

In this case, the flat surface portion 149*b* may block air introduced along the direction (the direction of arrow A) of the air flow. When the air flows through the upper side of the flat surface portion 149*b* and the dust contained in the air falls from the upper side thereof and sits on the connection bracket 149, the dust may slide downward (in the direction of arrow B) along the discharge inclining surface 149*a*. Accordingly, dust accumulated on the upper surface of the connection bracket 149 may be minimized.

As illustrated in FIG. 21, the filter rib R described above may be provided at the side of the direction of the air flow formed by the guide flow path (the direction of arrow A), such that a portion of air introduced along the direction of the air flow may (along the direction of arrow A) is prevented from being introduced to the gap between the surface of the connecting plate 128 and the inner surface of the housing 1.

In some embodiments, a relatively small portion of the air may be introduced to the gap between the surface of the connecting plate 128 and the inner surface of the housing 1. However, although dust contained in the introduced air falls from above and sits on the connection bracket 149, the dust may slide downward (in the direction of arrow B) along the discharge inclining surface 149*a*.

As a summary, dust may be prevented from being introduced to the upper portion of the connection bracket 149 because (i) first, before the introduced air is rotated in full scale and accelerated, the air may meet the front surface part 124B' of the guide fence 124B so that the introduced air may be prevented from escaping to the gap N between the inner surface 20 of the housing 1 and the guide fence 124B, (ii) blocking walls 128*c* and 148*c* may be provided in the connecting plate 128 by extending from the connecting plate 128 in the opposite direction of the direction A of the air flow so that dust moving along the air flow may be blocked from being introduced to the connection bracket 149, (iii) the filter rib R may be provided at the position close to the entrance Ea of the guide flow path E, which guides the air flow, of the opposite sides of the raising/lowering channel GH so that the air may be blocked once again by the filter rib R, and (iv) although a portion of the air is introduced to the gap between the surface of the connecting plate 128 and the inner surface of the housing 1, dust contained in the portion of the air may slide toward the bottom of the dust collection space S1 along the discharge inclining surface 149*a* of the connection bracket 149.

Regarding the structure in which the reinforcement plate 140 is assembled with the connecting plate 128, as illustrated in FIGS. 18 and 19, multiple holes may be provided in the cleaning body 120. The holes may be formed in the raising/lowering direction of the cleaning unit 110. In some embodiments, a first assembly hole H1, a second assembly hole H2, and a third assembly hole H3 may be provided in the cleaning body 120. The first assembly part 145 in the assembly body 141 of the reinforcement plate 140 may be assembled with the first assembly hole H1; the second assembly part 146 may be assembled with the second assembly hole H2; and the third assembly part 147 may be assembled with the third assembly hole H3.

Figure 22:
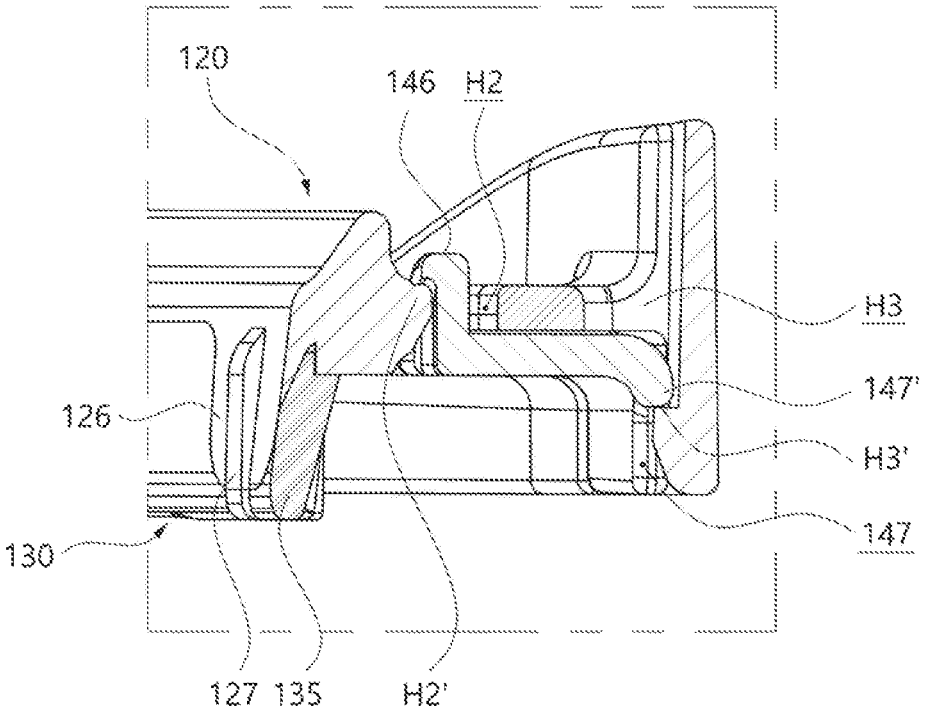
FIG. 22 is a sectional view taken along line V-V' of FIG. 18.

The first assembly part 145 may be inserted into and hooked to the first assembly hole H1. Referring to FIG. 22 which is a sectional view taken along line of FIG. 18, the end of the second assembly part 146 inserted to the second assembly hole H2 may be held in and assembled with an assembly end H2' located at the edge of the second assembly hole H2. The third assembly part 147 inserted to the third assembly hole H3 may form an empty space (see FIG. 19), but an assembly end part 147' may be provided at the inner side thereof. Accordingly, the assembly end part 147' may be held in and assembled with a seating end H3' located at the edge of the entrance of the third assembly hole H3. This assembly structure is provided by way of example, and the reinforcement plate 140 may be assembled with the connecting plate 128 in various other configurations. For example, the reinforcement plate 140 may be assembled to the cleaning body 120 by an insert injection method, by using a separate fastener, or any other suitable means.

As described above, just because all the components constituting of the cleaner according to the embodiment of the present disclosure have been described as being combined into one or operating in the combination, the present disclosure is not necessarily limited to such embodiments. That is, if it is within the scope of the purpose of the present disclosure, all the components may be selectively combined into more than one and operated. In addition, terms such as "include," "constitute," or "have" described above, unless otherwise stated, mean that the corresponding component may be present. Accordingly, it should be construed that other components are not excluded, but may be included. All terms, including technical or scientific terms, have the same meaning as commonly understood by those skilled in the technical field to which the present disclosure belongs, unless defined otherwise. Commonly used terms, such as terms defined in the dictionary, should be interpreted as being consistent with the context of the relevant technology, and in the present disclosure, unless explicitly defined, should not be interpreted as having an ideal or excessively formal meaning.

What is claimed is:

1. A cleaning apparatus comprising:

a housing having an introduction opening through which air is introduced;

a filter configured to be mounted in an inner space of the housing, and defining a dust collection space between the filter and an inner surface of the housing;

a cleaner configured to surround the filter, and configured to be raised and lowered inside the dust collection space, wherein, when the cleaner is in an initial position, at least a portion of the cleaner is connected to an air introduction path extending from the introduction opening to form a guide flow path to guide a flow of the introduced air;

a connecting plate provided in the cleaner to face the inner surface of the housing and extending in a raising/lowering direction of the cleaner; and a manipulator coupled to the connecting plate and lifted together with the cleaner, wherein a connection bracket is provided at a connection portion between the connection plate and the manipulator, wherein a discharge inclining surface is formed on an upper surface of the connection bracket, wherein a height of the discharge inclining surface varies along a circumferential direction of the cleaner, wherein the height of the discharge inclining surface gradually decreases along a direction of the air flow formed by the guide flow path, wherein a raising/lowering channel is recessed in the inner surface of the housing along the raising/lowering direction of the cleaner, wherein at least a portion of a connection bracket connecting the connecting plate and the manipulator is inserted into the raising/lowering channel, and wherein the connection bracket is connected to a movable rail of the manipulator in the raising/lowering channel.

2. The cleaning apparatus of claim 1, wherein a portion of the connection bracket is passed through in a direction parallel to a raising/lowering direction of the manipulator, and wherein the movable rail is inserted into the portion of the connection bracket.

3. The cleaning apparatus of claim 1, wherein the connection bracket comprises a flat surface portion formed parallel to a direction in which the connection bracket is configured to be raised and lowered, the flat surface portion facing a direction of the air flow formed by the guide flow path, and wherein the highest position of the discharge inclining surface is formed at an upper end of the flat surface portion.

4. The cleaning apparatus of claim 3, wherein the flat surface portion faces an inner surface of the raising/lowering channel.

5. The cleaning apparatus of claim 1, further comprising a filter rib protruding from at least one of a side of the inner surface of the housing or an outer surface of the connecting plate facing the inner surface of the housing.

6. The cleaning apparatus of claim 5, wherein the filter rib is disposed at a position away from the raising/lowering channel, and wherein the filter rib is disposed at a position spaced apart from the raising/lowering channel in a direction opposite to the air flow direction formed by the guide flow path.

7. The cleaning apparatus of claim 5, wherein the filter rib extends along a raising/lowering direction of the connecting plate.

8. The cleaning apparatus of claim 1, wherein a blocking wall extends from the connecting plate in a direction opposite to a direction in which air flows along the guide flow path.

9. The cleaning apparatus of claim 8, wherein a filter rib protrudes from the inner surface of the housing toward a surface of the blocking wall.

10. The cleaning apparatus of claim 1, further comprising a reinforcement plate coupled to the connecting plate, wherein the connection bracket is disposed in the reinforcement plate to connect the reinforcement plate to the manipulator.

11. The cleaning apparatus of claim 10, wherein the reinforcing plate comprises:

an assembly body coupled to the guide flow path and forming a part of the guide flow path; and a reinforcing body extending from the assembly body and to which the connection bracket is coupled.

12. The cleaning apparatus of claim 11, wherein an assembly part protrudes upward from the assembly body, and wherein an assembly hole into which the assembly part is inserted is formed in the cleaner.

13. The cleaning apparatus of claim 1, wherein the manipulator comprises:

a manipulation housing coupled to the housing;

a fixed rail extending in the raising/lowering direction of the cleaner from the inside of the manipulation housing;

the movable rail extending parallel to the fixed rail and moving up and down inside the manipulation housing;

a manipulation lever having a button part exposed to the outside of the manipulation housing and lifting the movable rail while moving up and down along the fixed rail; and a spring disposed on the fixed rail and providing elastic force to the manipulation lever in a direction in which the manipulation lever returns to an initial position.

14. The cleaning apparatus of claim 13, wherein a connection block is connected to the manipulation lever, the connection block being connected between the fixed rail and the movable rail, wherein the connection block moves up and down along the fixed rail together with the manipulation lever, and wherein the connection block moves up and down the movable rail.

15. The cleaning apparatus of claim 13, wherein at least a part of the movable rail is disposed inside the raising/lowering channel recessed in the inner surface of the housing, and wherein the movable rail is connected to the connection bracket of the cleaner inside the raising/lowering channel.

16. The cleaning apparatus of claim 15, wherein an entire height of the manipulation housing is higher than that of the raising/lowering channel.

17. A cleaning apparatus comprising:

a housing having an introduction opening through which air is introduced;

a filter configured to be mounted in an inner space of the housing, and defining a dust collection space between the filter and an inner surface of the housing;

a cleaner configured to surround the filter, and configured to be raised and lowered inside the dust collection space, wherein, when the cleaner is in an initial position, at least a portion of the cleaner is connected to an air introduction path extending from the introduction opening to form a guide flow path to guide a flow of the introduced air; and a connecting plate provided in the cleaner to face the inner surface of the housing and extending in a raising/lowering direction of the cleaner; and a manipulator coupled to a connection bracket provided in the cleaner connecting plate and lifted together with the cleaner, wherein a discharge inclining surface is formed at an upper surface of the connection bracket, wherein a height of the discharge inclining surface varies along a circumferential direction of the cleaner, and wherein the height of the discharge inclining surface gradually decreases along a direction of the air flow formed by the guide flow path, wherein a raising/lowering channel is recessed in the inner surface of the housing along the raising/lowering direction of the cleaner, wherein at least a portion of the connection bracket connecting the connecting plate and the manipulator is inserted into the raising/lowering channel, and wherein the connection bracket is connected to a movable rail of the manipulator in the raising/lowering channel.

* * * * *